US006449996B1

(12) United States Patent
Hirabayashi et al.

(10) Patent No.: US 6,449,996 B1
(45) Date of Patent: Sep. 17, 2002

(54) METHOD OF HOT-ROLLING METAL PIECES

(75) Inventors: Takeshi Hirabayashi; Shigeru Isoyama; Takahiro Yamasaki; Hideyuki Nikaido, all of Chiba (JP)

(73) Assignee: Kawasaki Steel Corporation, Kobe (JP)

( * ) Notice: Subject to any disclaimer, the term of this patent is extended or adjusted under 35 U.S.C. 154(b) by 0 days.

(21) Appl. No.: 09/807,903

(22) PCT Filed: Sep. 16, 1999

(86) PCT No.: PCT/JP99/05043

§ 371 (c)(1),
(2), (4) Date: Apr. 19, 2001

(87) PCT Pub. No.: WO01/19543

PCT Pub. Date: Mar. 2, 2001

(30) Foreign Application Priority Data

Mar. 19, 1998 (JP) ..... 10-070584
Mar. 20, 1998 (JP) ..... 10-071630

(51) Int. Cl.[7] ..... B21B 37/72

(52) U.S. Cl. ..... 72/12.5; 72/11.5; 72/203; 72/365.2

(58) Field of Search ..... 72/8.8, 11.5, 12.5, 72/203, 365.2

(56) References Cited

U.S. PATENT DOCUMENTS 5,560,236 A * 10/1996 Onda et al. ..... 72/203
5,720,196 A * 2/1998 Tamai et al. ..... 72/203
6,126,503 A1 * 4/2001 Kitajima et al. ..... 72/8.3

FOREIGN PATENT DOCUMENTS

| | | |
|---|---|---|
| EP | 0 661 112 A1 | 7/1995 |
| EP | 0 738 548 A1 | 10/1996 |
| JP | A 5-277508 | 10/1993 |
| JP | A 7-1007 | 1/1995 |
| JP | A 7-241601 | 9/1995 |
| JP | A 9-29528 | 2/1997 |
| JP | A 9-103813 | 4/1997 |
| JP | A 10-272510 | 10/1998 |
| JP | A 11-169926 | 6/1999 |

* cited by examiner

*Primary Examiner*—Ed Tolan
(74) *Attorney, Agent, or Firm*—Oliff & Berridge, PLC

(57) ABSTRACT

The present invention eliminates the need to stop the operation of a line even when trouble arises before, during, or after an operation of joining metal blocks in hot rolling. According to a specific solving means of the present invention, when a succeeding metal block is to be subjected to hot finish rolling in succession to a preceding metal block after the leading end of the succeeding metal block is joined to a tail end 10B of the preceding metal block on the inlet side of a finish rolling mill 26, it is determined before and after joining whether or not endless rolling is impossible. When it is impossible, joining is aborted, and the succeeding metal block 12 is temporarily stopped, is fed again after the tail end 10B of the preceding metal block moves out of the finish rolling mill 26, and is finish-rolled under the conditions set for batch rolling. When joining was not performed successfully, a joint 11 is cut between a joining unit and the finish rolling mill 26, and the rolled material is bitten by the finish rolling mill set for batch rolling.

12 Claims, 30 Drawing Sheets

FIG. 11

THICKNESS CHANGE CONTROL CAPABILITY IN ACCORDANCE WITH TRAVELING STRIP THICKNESS CHANGE

| STRIP THICKNESS H (mm) | AMOUNT OF CHANGE CONTROLLABILITY IN STRIP THICKNESS ΔH (mm) |
|---|---|
| $H < 2.0$ | $\Delta H \leqq 0.4$ |
| $2.0 \leqq H < 4.0$ | $\Delta H \leqq 1.0$ |
| $4.0 \leqq H < 6.0$ | $\Delta H \leqq 1.5$ |
| $6.0 \leqq H$ | $\Delta H \leqq 2.0$ |

FIG. 27

(a) ROLLING SCHEDULE FOR THIRD BLOCK (SUCCEEDING METAL BLOCK) BEFORE JOINING IS ABORTED

| | | BLOCK | F1 | F2 | F3 | F4 | F5 | F6 | F7 |
|---|---|---|---|---|---|---|---|---|---|
| STRIP THICKNESS(mm) | | 30 | 15.0 | 8.25 | 4.7 | 2.9 | 1.8 | 1.25 | 1.0 |
| SPEED (mpm) | THREAD | 33.3 | 66.7 | 121 | 213 | 345 | 556 | 800 | 1000 |
| | TOP | 50 | 100 | 182 | 319 | 517 | 833 | 1200 | 1500 |

(b) ROLLING SCHEDULE FOR THIRD BLOCK (SUCCEEDING METAL BLOCK) AFTER JOINING IS ABORTED

| | | BLOCK | F1 | F2 | F3 | F4 | F5 | F6 | F7 |
|---|---|---|---|---|---|---|---|---|---|
| STRIP THICKNESS(mm) | | 30 | 18.0 | 11.5 | 8.0 | 5.6 | 4.1 | 3.1 | 2.6 |
| SPEED (mpm) | THREAD | 73.7 | 123 | 192 | 276 | 395 | 539 | 713 | 850 |
| | TOP | 82 | 137 | 215 | 309 | 441 | 602 | 797 | 950 |

FIG. 28

| | FIRST BLOCK | SECOND BLOCK | THIRD BLOCK | FOURTH BLOCK |
|---|---|---|---|---|
| TARGET THICKNESS BEFORE JOINT PORTION CUTTING OFF | 1.2mm | 1.0mm | 1.0mm | 1.2mm |
| TARGET THICKNESS AFTER JOINT PORTION CUTTING OFF | 1.2mm (LEADING END BATCH) | 1.0mm (JOINT) | 2.6mm (BATCH) | 1.2mm (BATCH) |

FIG. 29

(a) ROLLING SCHEDULE FOR SECOND BLOCK (SUCCEEDING METAL BLOCK) BEFORE JOINING IS ABORTED

| | | BLOCK | F1 | F2 | F3 | F4 | F5 | F6 | F7 |
|---|---|---|---|---|---|---|---|---|---|
| STRIP THICKNESS(mm) | | 40 | 25.6 | 17.7 | 12.3 | 9.0 | 6.7 | 5.1 | 4.0 |
| SPEED (mpm) | THREAD | 26 | 41 | 59 | 85 | 116 | 155 | 204 | 260 |
| | TOP | 26 | 41 | 59 | 85 | 116 | 155 | 204 | 260 |

(b) ROLLING SCHEDULE FOR SECOND BLOCK (SUCCEEDING METAL BLOCK) AFTER JOINING IS ABORTED

| | | BLOCK | F1 | F2 | F3 | F4 | F5 | F6 | F7 |
|---|---|---|---|---|---|---|---|---|---|
| STRIP THICKNESS(mm) | | 40 | 25.6 | 17.7 | 12.3 | 9.0 | 6.7 | 5.1 | 4.0 |
| SPEED (mpm) | THREAD | 26 | 41 | 59 | 85 | 116 | 155 | 204 | 260 |
| | TOP | 26 | 41 | 59 | 85 | 116 | 155 | 204 | 260 |

FIG. 30

| | FIRST BLOCK | SECOND BLOCK | THIRD BLOCK | FOURTH BLOCK |
|---|---|---|---|---|
| TARGET THICKNESS BEFORE JOINT PORTION CUTTING OFF | 4.0mm | 4.0mm | 4.0mm | 4.0mm |
| TARGET THICKNESS AFTER JOINT PORTION CUTTING OFF | 4.0mm (LEADING END BATCH) | 4.0mm (LEADING END BATCH) | 4.0mm (JOINT) | 4.0mm (JOINT) |

FIG. 33

(a) ROLLING SCHEDULE FOR THIRD BLOCK (SUCCEEDING METAL BLOCK) BEFORE JOINT IS ABORTED

| | | BLOCK | F1 | F2 | F3 | F4 | F5 | F6 | F7 |
|---|---|---|---|---|---|---|---|---|---|
| STRIP THICKNESS(mm) | | 30 | 15.0 | 8.25 | 4.7 | 2.9 | 1.8 | 1.25 | 1.0 |
| SPEED (mpm) | THREAD | 33.3 | 66.7 | 121 | 213 | 345 | 556 | 800 | 1000 |
| | TOP | 50 | 100 | 182 | 319 | 517 | 833 | 1200 | 1500 |

(b) ROLLING SCHEDULE FOR THIRD BLOCK (SUCCEEDING METAL BLOCK) AFTER JOINT IS ABORTED

| | | BLOCK | F1 | F2 | F3 | F4 | F5 | F6 | F7 |
|---|---|---|---|---|---|---|---|---|---|
| STRIP THICKNESS(mm) | | 30 | 18.0 | 11.5 | 8.0 | 5.6 | 4.1 | 3.1 | 2.6 |
| SPEED (mpm) | THREAD | 73.7 | 123 | 192 | 276 | 395 | 539 | 713 | 850 |
| | TOP | 82 | 137 | 215 | 309 | 441 | 602 | 797 | 950 |

FIG. 34

| | FIRST BLOCK | SECOND BLOCK | THIRD BLOCK | FOURTH BLOCK |
|---|---|---|---|---|
| TARGET THICKNESS BEFORE JOINT PORTION CUTTING OFF | 1.2mm | 1.0mm | 1.0mm | 1.2mm |
| TARGET THICKNESS AFTER JOINT PORTION CUTTING OFF | 1.2mm (LEADING END BATCH) | 1.0mm (JOINT) | 2.6mm (BATCH) | 1.2mm (BATCH) |

FIG. 35

(a) ROLLING SCHEDULE FOR THIRD BLOCK (SUCCEEDING METAL BLOCK) BEFORE JOINT IS ABORTED

| | | BLOCK | F1 | F2 | F3 | F4 | F5 | F6 | F7 |
|---|---|---|---|---|---|---|---|---|---|
| STRIP THICKNESS(mm) | | 40 | 25.6 | 17.7 | 12.3 | 9.0 | 6.7 | 5.1 | 4.0 |
| SPEED (mpm) | THREAD | 26 | 41 | 59 | 85 | 116 | 155 | 204 | 260 |
| | TOP | 26 | 41 | 59 | 85 | 116 | 155 | 204 | 260 |

(b) ROLLING SCHEDULE FOR THIRD BLOCK (SUCCEEDING METAL BLOCK) AFTER JOINT IS ABORTED

| | | BLOCK | F1 | F2 | F3 | F4 | F5 | F6 | F7 |
|---|---|---|---|---|---|---|---|---|---|
| STRIP THICKNESS(mm) | | 40 | 25.6 | 17.7 | 12.3 | 9.0 | 6.7 | 5.1 | 4.0 |
| SPEED (mpm) | THREAD | 26 | 41 | 59 | 85 | 116 | 155 | 204 | 260 |
| | TOP | 26 | 41 | 59 | 85 | 116 | 155 | 204 | 260 |

FIG. 36

| | FIRST BLOCK | SECOND BLOCK | THIRD BLOCK | FOURTH BLOCK |
|---|---|---|---|---|
| TARGET THICKNESS BEFORE JOINT PORTION CUTTING OFF | 4.0mm | 4.0mm | 4.0mm | 4.0mm |
| TARGET THICKNESS AFTER JOINT PORTION CUTTING OFF | 4.0mm (LEADING END BATCH) | 4.0mm (LEADING END BATCH) | 4.0mm (JOINT) | 4.0mm (JOINT) |

FIG. 37
(a)
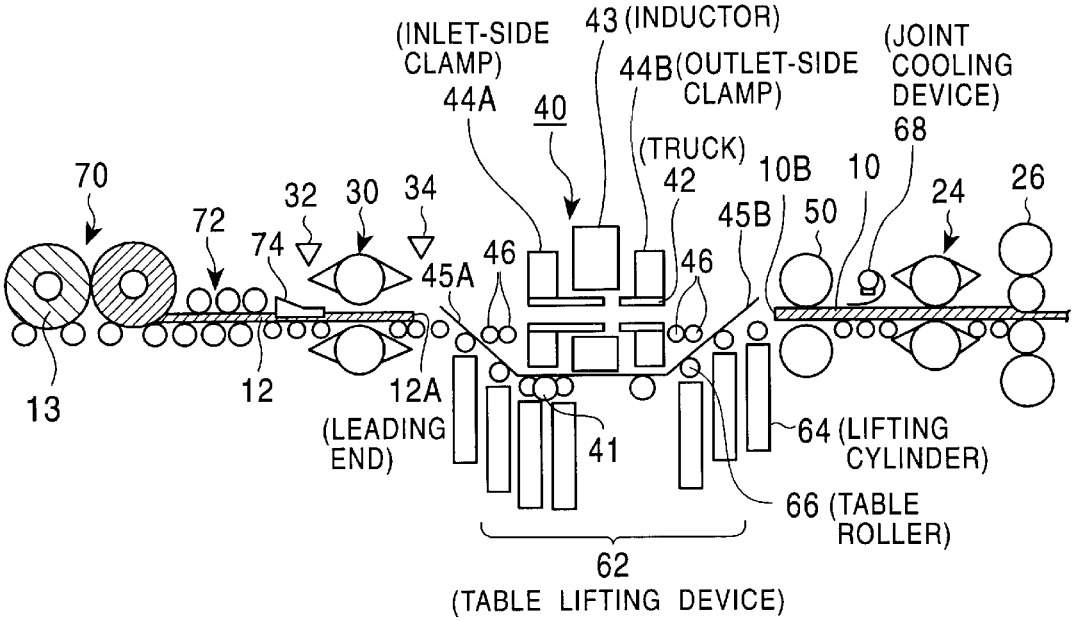
(b)
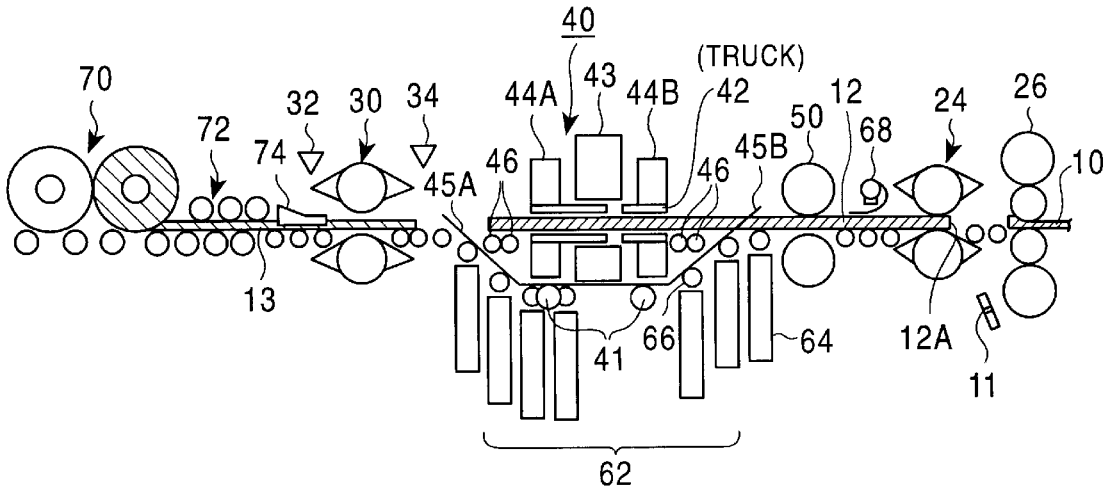

METHOD OF HOT-ROLLING METAL PIECES

This application is a 35 USC 371 of PCT/JP99/05043 filed Sep. 16, 1999.

TECHNICAL FIELD

The present invention relates to a hot rolling method for metal blocks, and more particularly, relates to a metal block hot rolling method for joining several to several tens of metal blocks, such as sheet bars, slabs, billets, or blooms, and subjecting the metal blocks to continuous rolling.

BACKGROUND ART

In a conventional metal block hot rolling line, metal blocks to be rolled are individually subjected to heating, rough-rolling, and finish-rolling, and are finished as hot-rolled strips having a desired thickness. In such a batch rolling method, however, the line is inevitably stopped due to poor biting of rolled materials. Moreover, the yield is significantly decreased due to odd shapes of the leading end and the tail end of the rolled materials.

For this reason, an endless rolling method has been recently adopted in which the tail end and the leading end of metal blocks to be rolled are coupled (hereinafter referred to as "joined") in advance of finish-rolling, and the metal blocks are continuously supplied to a hot rolling line so as to be rolled.

In such endless rolling, since the poor biting and the odd shapes described above occur only at the leading end of the first and the tail end of the last of a plurality of joined subsequent metal blocks, such can be greatly reduced. Since the poor biting and odd shapes become more likely to arise as the thickness of the finish-rolled strips decreases, there used to be such problems in the conventional batch rolling method, and the producible thickness of rolled strips used to have a lower limit. In endless rolling, however, a thick metal strip is rolled first, next the thickness of the finish-rolled strip is changed during rolling after the leading end of the thick strip threads through a finish-rolling unit, and then the subsequent thin metal strips are rolled, so it can produce thinner gage rolled products than before.

As a hot rolling system that can perform the above-described endless rolling, for example, Japanese Unexamined Patent Publication No. 7-241601 discloses a hot rolling line in which arranged, in order along the line on the outlet side of a heating furnace 20, are a rough-rolling unit 22 composed of, for example, three stands R1 to R3, a winding and rewinding device 70, a leveler 72, a centering guide 74, a joining crop shear 30, a movable joining unit (welder) 40 moving in synchronization with the feeding of metal blocks, a crop shear 24, a finish-rolling unit 26 composed of, for example, seven stands F1 to F7, and, for example, two coilers 28 for alternately coiling, as shown in FIG. 2.

Japanese Unexamined Patent Publication No. 7-1007 discloses an example of a movable joining unit, in which plural lifting table rollers 66 to be supplied with balanced oil pressure from hydraulic oil pipes connected uniquely are pressed down by guides 45A and 45B mounted on a joining unit 40 and are raised by the balanced oil pressure to the initial metal block supporting height in accordance with the traveling of the joining unit, as shown in FIG. 3, thereby preventing the table rollers and the joining unit from colliding with each other.

Japanese Unexamined Patent Publication No. 11-169926 discloses a method in which, in order to prevent operating trouble or defective coils due to inaccurate setting change and delay of setting change, by promptly and accurately changing the settings when endless rolling for joining and rolling a preceding metal block and a succeeding metal block is changed to batch rolling for rolling a preceding metal block and a succeeding metal block without joining, both rolling conditions of endless rolling and conditions of batch rolling are predetermined when slabs are subjected to endless rolling, and operating conditions at each point in a hot rolling line are calculated for both endless rolling and batch rolling.

However, measures to be taken when trouble arises in an actual joining operation in such a continuous hot rolling line have not been hitherto specifically disclosed. If there are no measures to be taken in case of trouble, serious trouble may arise.

In general, materials (a preceding metal block 10 and a succeeding metal block 12) are pushed upward from below by loopers 16 during finish rolling, as shown in FIG. 4, in order to apply tension to the materials between the stands. For example, if the unjoined materials are supplied to the finish-rolling unit 26 with a false determination that the materials have been joined, since the loopers 16 between the stands are keeping the materials in an upward position, as shown in FIG. 7, the leading end of the succeeding metal block is flipped up by the looper 16, is not bitten by the next stand, and jams between the stands. Thereby, the rolling operation cannot be continued, and the operation of the line is stopped.

Similarly, in a case in which although a joint 11 between the tail end 10B of the preceding metal block and the leading end of the succeeding metal block 12A is incomplete and has an insufficient strength, as shown in FIG. 5, it is subjected to finish rolling with a false determination that the joint is complete, as shown in FIG. 6, the joint 11 may be broken by tensile force, the leading end of the succeeding metal block 12A is flipped up by the looper 16, is not bitten by the next stand, and jams between the stands, as shown in FIG. 7. Due to this, the rolling operation cannot be continued, and the operation of the line is stopped. Numeral 14 in FIG. 6 denotes burrs produced by joining.

There are three basic trouble cases, as follows:

(1) It is impossible to start joining metal blocks.

(2) Joining results in failure due to trouble during the joining operation.

(3) Although a joint is formed, it has low strength and is incomplete.

The present invention has been made to overcome the above-described conventional problems, and an object of the present invention is how to deal with the above three trouble cases.

DISCLOSURE OF INVENTION

This invention solves the above problems by a hot rolling method for metal blocks using a hot rolling system for joining the leading end of a succeeding metal block and the tail end of a preceding metal block on the inlet side of a finish-rolling mill and for finish-rolling the succeeding metal block and the preceding metal block continuously. In this method, it is determined before, during, and after the joining operation whether or not the succeeding metal block can be finish-rolled in succession to the preceding metal block. When it is determined that the succeeding metal block cannot be finish-rolled in succession to the preceding metal block, the joining operation is aborted or a joint is cut, and rolling operations (operations concerned with all the devices placed downstream from a joining unit, such as finish rolling, coiling, and run-out cooling) are performed in downstream devices including the joining unit under the conditions set for batch rolling. FIGS. 37(*a*) and 37(*b*) show the positional relationship among a preceding metal block 10, a succeeding metal block 12, a subsequent metal block 13, and a cut joint, when the joining operation is aborted, and when the joint is cut, respectively (Invention 1).

Regarding the succeeding metal block that is not joined or is incompletely joined, if the devices (the joining unit and a treatment unit such as a deburring device) concerned with joining remain in a joining state, the leading end of the succeeding metal block that is not joined or that the incomplete joint resulted in being broken during traveling, after the joining operation is aborted, is at a risk of sticking in the interior of the devices concerned with joining and making it impossible for the leading end of the succeeding metal block to be threaded therethrough. Accordingly, the devices are brought into a state that allows the leading end of the succeeding metal block to be threaded therethrough, and the leading end of the succeeding metal block is then threaded through the devices concerned with joining. That is, according to this invention, the above problems are solved by the hot rolling method for metal blocks is using a hot rolling system for joining the leading end of a succeeding metal block to the tail end of a preceding metal block on the inlet side of a finish-rolling mill and for finish-rolling the succeeding metal block and the preceding metal block continuously. In this method, when it is determined that the succeeding metal block cannot be finish-rolled in succession to the preceding metal block, an operation of joining the leading end of the succeeding metal block and the tail end of the preceding metal block is aborted when the metal blocks are separate. When the metal blocks are joined incompletely, a region including a joint therebetween is cut between the joining unit and a finish-rolling mill, the downstream devices for joining including the joining unit are brought into a state that allows the leading end of the succeeding metal block to be threaded therethrough, and at least the leading end of the succeeding metal block is bitten by the finish-rolling mill set for batch rolling (Invention 2).

According to this invention, when it is determined, before joining, that the succeeding metal block cannot be finish-rolled in succession to the preceding metal block, the joining devices are brought into a state that allows the leading end of the succeeding metal block to be threaded therethrough. After the tail end of the preceding metal block moves out of the finish-rolling mill, a setting of the finish-rolling mill is made for batch rolling so that the leading end of the succeeding metal block is bitten by the finish-rolling mill. Subsequently, the leading end of the succeeding metal block is threaded through the joining devices and is bitten by the finish-rolling mill. Thereby, the above problems are solved (Invention 3).

According to this invention, after joining, it is determined, according to whether or not the joining operation was performed successfully, whether or not the succeeding metal block and the preceding metal block can be finish-rolled in succession. When it is determined that the joining operation was not performed successfully, a region including the joint therebetween is cut between the joining unit and the finish-rolling mill, and at least the leading end of the succeeding metal block is bitten by the finish-rolling mill set for batch rolling. Thereby, the above problems are solved. In this case, it is preferable that the devices disposed on the feeding path from the joining unit to a joint cutting means be placed in a state that allows the leading end of the succeeding metal block to be threaded therethrough so that the leading end is prevented from sticking and stopping even when the joint is broken during feeding (Invention 4).

In this invention, the joint between the preceding metal block and the succeeding metal block incompletely joined may be fed in synchronized velocity with the travel of the joining unit, the joining unit may travel and stop at the most downstream end of the travel zone, and the preceding metal block and the succeeding metal block may be continuously fed, without being stopped, at the feeding speed of the preceding metal block whose leading end has been already rolled by the finish-rolling mill (Invention 5).

In general, endless rolling adopts an operation manner in which the leading end of the first metal strip in endless rolling is rolled to a somewhat larger thickness so as to be threaded through the finish-rolling mill, the traveling sheet thickness in the finish-rolling mill is changed after the leading end has been threaded through the finish-rolling mill, and thin metal strips are rolled. Therefore, joining of the leading ends of the second and subsequent metal blocks in endless rolling is aborted, or the leading ends are bitten by the finish-rolling mill after the incomplete joint is cut. That is, when the leading end is subjected to batch rolling, the target finishing thickness is too small, and the threading ability is unstable, which may make rolling impossible. On the assumption of such a case, a thickness range that allows batch rolling is preset. When the target finishing thickness of the succeeding metal strip is out of the thickness range, finish rolling is performed while the finishing thickness of at least the leading end of the succeeding metal strip is changed to be within the thickness range. In this case, even if the target thickness of the succeeding metal strip, which has been aborted to be joined to the preceding metal block, is small, the thickness at the leading end is changed to be larger, and the succeeding metal strip is bitten by the finish-rolling mill, which achieves stable finish rolling. That is, according to this invention, when it is determined that the succeeding metal block cannot be finish-rolled in succession to the preceding metal block, the finishing thickness range that allows batch rolling is preset, and the succeeding metal block is finish-rolled with the finishing thickness of at least the leading end thereof changed to be within the thickness range when the target finishing thickness of the succeeding metal strip is out of the thickness range. Thereby, the above problems are solved (Invention 6).

According to this invention, in a case in which it is determined that the succeeding metal block cannot be finish-rolled in succession to the preceding metal block, when the joining unit is mounted on a truck and moves while the truck sequentially depressing lifting table rollers with its movement with table pressing guides on the inlet side and the outlet side of the joining device placed in the down position, and the lifting table rollers sequentially returning to the unpressed initial height state after the truck passes, the truck is stopped, after the joining operation is stopped or is finished incompletely, at a position such that the distance Q between the table rollers and the outermost one of feeding rolls provided with the truck prevents the succeeding metal block from entering between the rolls due to downward bending while the outlet-side table pressing guide is in the upper limit position. Then, the outlet-side table pressing guide is raised to the upper limit position, and the succeeding metal block or the joint is fed downstream from the joining unit. Thereby, the above problems are solved.

Furthermore, according to this invention, when the incomplete joint is fed downstream from the joining unit, even if separated, the joining unit is stopped at a position such that the gap between adjacent table rollers prevents the leading end of the succeeding metal block, after separating, from bending downward and from entering between the table rolls. Then, at least the table pressing guide on the downstream side (on the outlet side of the joining unit) is raised, and the preceding metal block and the succeeding metal block are not stopped, but are fed at the feeding speed of the preceding metal block whose leading end has been already rolled by the finish-rolling mill (Invention 7).

According to this invention, when the joining unit clamps the succeeding metal block and the preceding metal block with a predetermined gap formed between the leading end of the succeeding metal block and the tail end of the preceding metal block, heats the leading end and the tail end in this state, and joins the leading end and the tail end by pressing, it is determined, based on the amount of displacement by pressing, whether or not joining has been successfully performed (Invention 8).

According to this invention, it is determined before, during, and after joining whether or not the succeeding metal block can be finish-rolled in succession to the preceding metal block. When it is determined that it is impossible, a treatment unit disposed between the joining unit and the finish-rolling mill so as to treat the joint is brought into a state in which the joint is not treated. The leading end of the succeeding metal block is threaded therethrough when the joining operation is aborted, and the joint is threaded therethrough when the joint is incomplete (Invention 9).

According to this invention, in a case in which a deburring device is placed on the outlet side of the joining unit so as to deburr the joint by rotary cutters, which are disposed above and below the pass line to be rotated in the opposite direction from the feeding direction of the succeeding metal block, and to remove bur produced at the joint, deburring by the deburring device is aborted when it is determined that the joining operation was not performed successfully (Invention 10).

On the other hand, the succeeding metal block bitten by the finish-rolling mill with its finishing thickness changed and a subsequent metal block subsequent to the succeeding metal block can be subjected to endless rolling while the leading end and the tail end thereof are joined, as long as no trouble arises. However, this involves conditions. Since at least the leading end of the succeeding metal block is sometimes rolled to a thicker thickness than the target finishing thickness others throughout its length, there is caused a need to unexpectedly change the traveling sheet thickness, or to change the traveling sheet thickness by a greater amount than predetermined in order to roll the succeeding metal block and the subsequent metal block in succession. If the amount of change in traveling sheet thickness is too large, shape control and the like during rolling cannot be finely performed, and it is significantly difficult to roll the portion with the changed traveling sheet thickness.

Accordingly, the present invention solves the above problems by the hot rolling method for metal strips using a hot rolling system in which the traveling sheet thickness can be changed to change the finishing thickness during finish rolling. In the method, the hot rolling system allows the traveling sheet thickness change for changing the finishing thickness during finish rolling, and a changeable thickness range in accordance with the traveling thickness change is preset. When a subsequent metal strip subsequent to the succeeding metal strip and the succeeding metal strip finish-rolled to a different thickness from the target thickness for continuous rolling are finish-rolled in succession, it is determined whether or not the amount of change in thickness from the finishing thickness of the succeeding metal strip to the target finishing thickness of the subsequent metal strip is within the changeable thickness range. When the change amount is out of the changeable thickness range, the finishing thickness of the subsequent metal strip is changed so that the amount of change in thickness be within the changeable thickness range, and the subsequent metal strip and the succeeding metal strip are joined and are subjected to continuous finish rolling. This makes it possible to roll (endless-roll) the succeeding metal strip and the subsequent metal strip in succession without any trouble even when the succeeding metal strip has been rolled to a greater thickness than the target value (Invention 11).

When the target thickness of the subsequent metal block is also achieved by batch rolling, or when none of the metal blocks to be joined can be finish-rolled to the target thickness even by sequentially joining the metal blocks from the subsequent metal block to the predetermined last block while changing the target thicknesses within the changeable traveling sheet thickness range, as described above, joining of the leading end of the subsequent metal block may preferably be aborted. This also applies to the materials subsequent to the subsequent metal block (Invention 12).

BRIEF DESCRIPTION OF THE DRAWINGS

FIG. 11 is a table showing an example of a thickness change control capability in accordance with the traveling sheet thickness change.

FIG. 27 is a view comparatively showing rolling schedules for the succeeding metal block before and after joining is aborted in Example 1.

FIG. 28 is a view comparatively showing target thicknesses of rolled materials in the continuous hot rolling in Example 1.

FIG. 29 is a view comparatively showing rolling schedules for the succeeding metal block before and after joining is aborted according in Example 2.

FIG. 30 is a view comparatively showing target thicknesses of rolled materials in the continuous hot rolling in Example 2.

FIG. 33 is a view comparatively showing rolling schedules for the succeeding metal block before and after the joint is cut in Example 3.

FIG. 34 is a view comparatively showing target thicknesses of rolled materials in the continuous hot rolling in Example 3.

FIG. 35 is a view comparatively showing rolling schedules for the succeeding metal block before and after the joint is cut in Example 4.

FIG. 36 is a view comparatively showing target thicknesses of rolled materials in the continuous hot rolling in Example 4.

FIGS. 37(*a*) and 37(*b*) are views showing the positional relationship among a preceding metal block, a succeeding metal block, a subsequent metal block, and a cut joint, respectively, when the joining operation is aborted, and when the joint is cut, according to the present invention.

BEST MODE FOR CARRYING OUT THE INVENTION

Embodiments of the present invention will be described in detail below with reference to the drawings.

Figure 1:
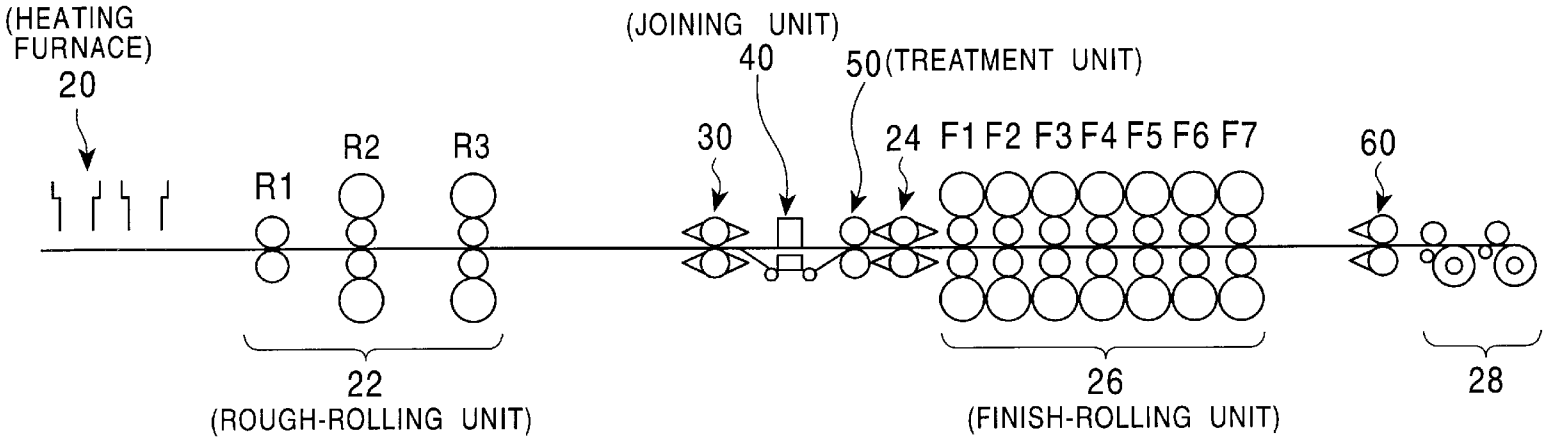
FIG. 1 is a front view of an example of a continuous hot rolling line to which the present invention is suitably applied.

FIG. 1 shows a continuous hot rolling line (including devices for joining) to which the present invention is suitably applied. A heating furnace 20, a rough-rolling unit 22, a crop shear 24, a finish-rolling unit 26, and coiling devices 28 are arranged, in that order, from the upstream of the line, in a manner similar to that in the conventional hot rolling line. In addition, a joining crop shear 30, a movable joining unit 40, and a treatment unit 50, such as a deburring device, are placed as devices for joining metal blocks between the rough-rolling unit 22 and the finish-rolling unit 26, and a cutting device 60, such as a strip shear, is placed on the inlet side of the coiling devices 28.

Figure 2:
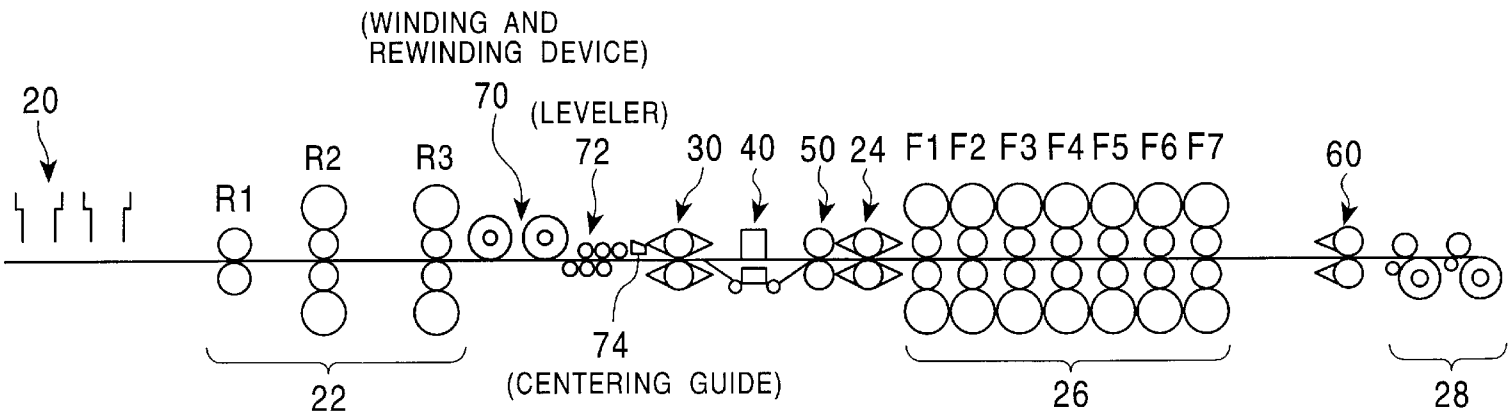
FIG. 2 is a front view of a modification of the continuous hot rolling line.

As a derivative of the line shown in FIG. 1, a winding and rewinding device 70 for timing control and a leveler 72 for correcting the bending of the leading end may be placed on the inlet side of the joining crop shear 30, as shown in FIG. 2.

Figure 3:
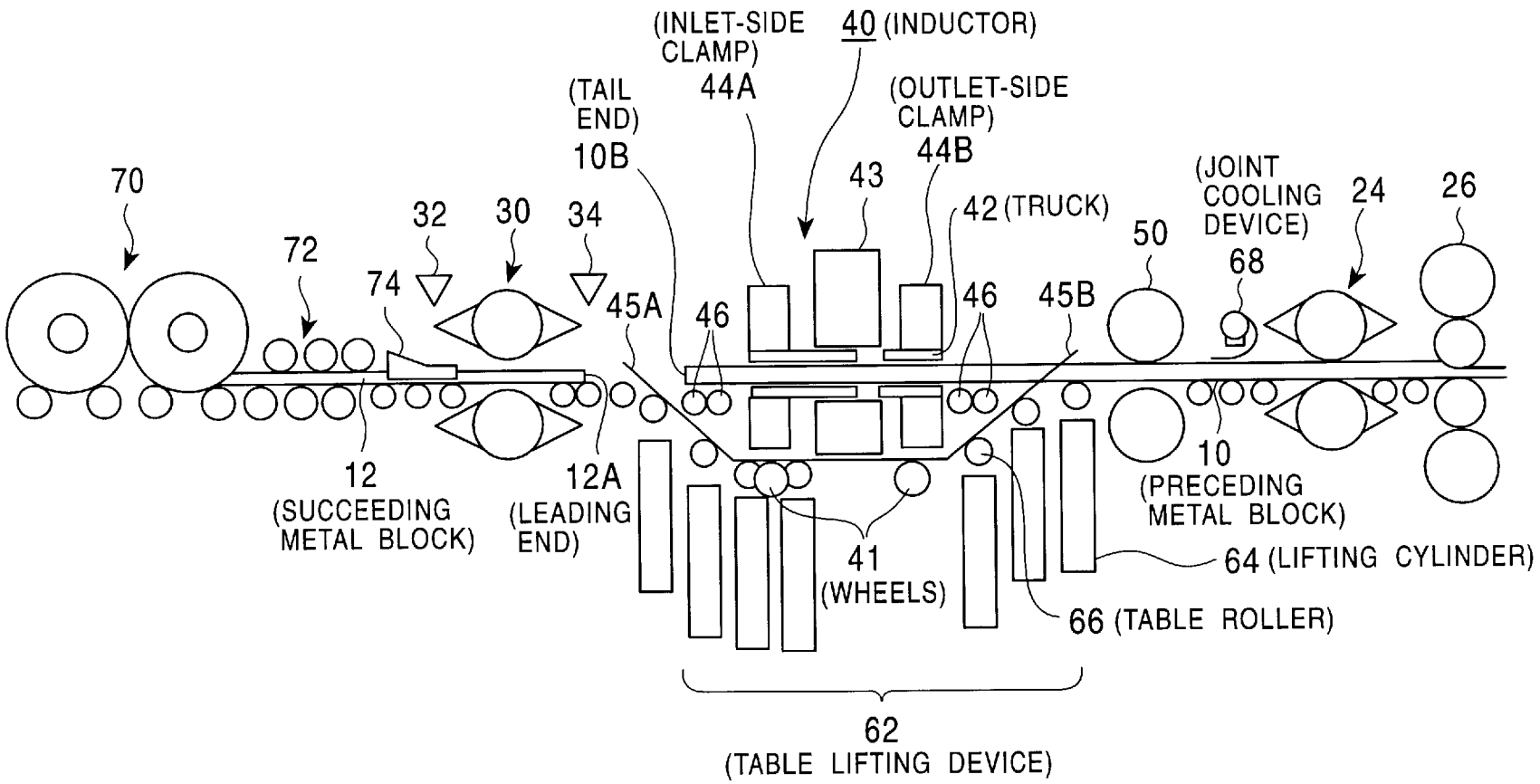
FIG. 3 is an enlarged front view showing the part of the continuous hot rolling line shown in FIG. 2 between the outlet side of a rough-rolling unit and the inlet side of a finish-rolling unit.
Figure 4:
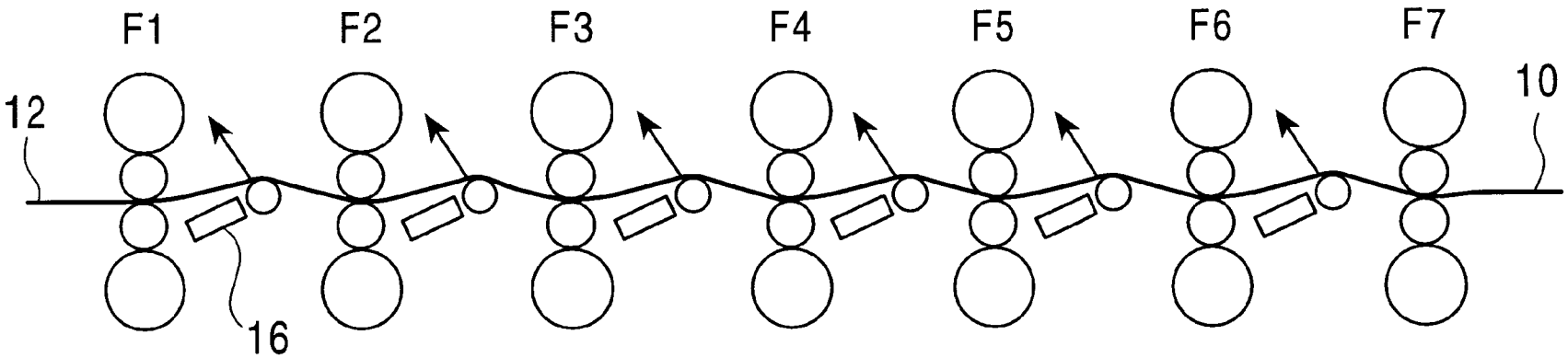
FIG. 4 is a front view showing a state in which materials are fed in the finish-rolling unit.

FIG. 3 is an enlarged view showing only the devices between the rough-rolling unit 22 and the finish-rolling unit 26. In the figure, numeral 10 denotes a preceding metal block, numeral 10B denotes the tail end thereof, numeral 12 denotes a succeeding metal block, numeral 12A denotes the leading end thereof, numeral 74 denotes a centering guide of the joining crop shear 30, numerals 32 and 34 denote metal detectors, numeral 62 denotes a table lifting device in relation to the movement of the joining unit, and having table rollers 66 to be moved up and down by lifting cylinders 64, and numeral 68 denotes a joint cooling device.

The joining unit 40 comprises an inductor 43 serving as a joining heater that is fixed at the center of a truck 42 moving in the metal block feeding direction with wheels 41 engaged with rails (not shown), an outlet-side clamp 44B mounted on the truck 42 so as to fix the tail end 10B of the preceding metal block 10 during joining, an inlet-side clamp 44A similarly mounted on the truck 42 so as to fix the leading end 12A of the succeeding metal block 12 during joining, an outlet-side pressing guide 45B and an inlet-side pressing guide 45A fixed to the truck 42 so as to move the table rollers 66 up and down corresponding the position of joining unit, and rollers 46 for supporting the metal block inside the joining unit 40.

At the joint, the tail end 10B of the preceding metal block is fixed by the outlet-side clamp 44B, and the leading end 12A of the succeeding metal block is fixed by the inlet-side clamp 44A at a predetermined distance from the tail end 10B. Subsequently, the leading end 12A and the tail end 10B are heated by the inductor 43, are pressed against each other, and are thereby joined. All the while, in accordance with the feeding of the metal blocks, the joining unit 40 also travels in the metal block feeding direction within the traveling zone shown in FIG. 8 at the same speed as that of feeding. Furthermore, the table rollers 66 corresponding the position of the joining unit 40 are allowed to be moved up and down by the lifting cylinders 64 so as not to interfere with the joining operation, and the table rollers 66 at the joining unit are depressed by the outlet-side pressing guide 45B and the inlet-side pressing guide 45A.

Figure 6:
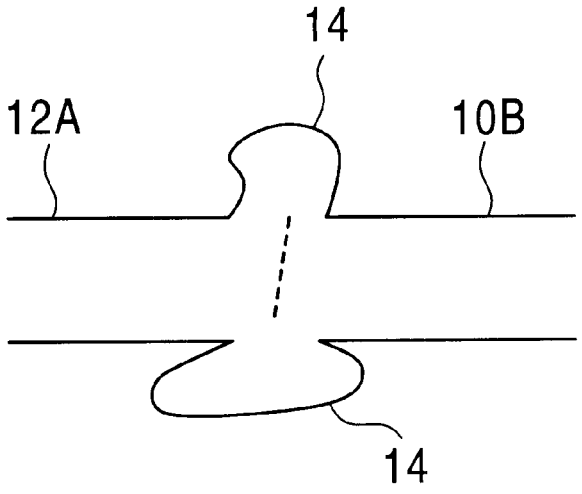
FIG. 6 is a side view showing a state in which burrs are produced at the metal block joint.

The treatment unit 50 comprises, as illustrated in the following FIG. 15, an upper rotary cutter 52 to be pressed down by a pressing-down device 51, a lower rotary cutter 54 to be pushed up by a pressing-up device 53, an openable and closeable apron 55, and upper and lower chip collecting devices 56 and 57. The treatment unit 50 serves to cut the burrs 14 at the joint, as shown in FIG. 6. Incidentally, the joining unit 40 remains at a maintenance position shown in the following FIG. 8 when the first block to be joined is threaded therethrough, and the inlet-side and outlet-side clamps 44A and 44B, the inductor 43, and the inlet-side and outlet-side table pressing guides 45A and 45B are in the raised position, thereby allowing the leading end of the block to be threaded therethrough. After threading, the joining unit 40 moves to a starting position with the inlet-side and outlet-side table pressing guides 45A and 45B moved down, and at least the inlet-side table pressing guide 45A is moved up, whereby the joining unit 40 is ready to start a joining operation. On the other hand, the treatment unit makes the first block to be joined threading therethrough while the pressing-down and pressing-up devices for the rotary cutters are released and the openable and closeable apron is closed. Since the pressing-down and pressing-up devices are released, the rotary cutters may begin to rotate in the opposite direction from the material feeding direction, or may rotate in the forward direction, as long as they accelerate in time to reach the cutting speed.

For example, it is assumed that the feeding of the succeeding metal block 12 is delayed because the widthwise edge of the sheet bar (succeeding metal block) rubs against the inlet-side centering guide 74 of the joining crop shear 30 and receives resistance due to meandering resulting from the cambering of the sheet bar during rough rolling. Then, since only the feeding of the preceding metal block 10 is continued, the leading end 12A of the succeeding metal block 12 cannot catch up with the tail end 10B of the preceding metal block, and the joining unit 40 cannot begin a joining operation. Accordingly, when a joining operation cannot be performed in a way like this due to any trouble, it is aborted according to the present invention.

When the joining operation is aborted, control is executed so that the movement of the joining unit 40 be stopped, and so that the feeding of the succeeding metal block 12 be temporarily stopped or be decelerated.

The rolling schedule for the succeeding metal block 12, after the joining operation is aborted, is changed to a rolling schedule for the first of a series of blocks to be joined (that is, the first metal block in the next endless rolling process), or to a rolling schedule for a batch-rolled material. When the feeding is delayed because the widthwise edge of the succeeding metal block leading end 12A rubs against the centering guide 74 on the inlet side of the joining crop shear, control is executed so that the centering guide 74 be further opened, or manual intervention be used.

More specifically, the succeeding metal block 12 is finish-rolled to a desired thickness after the joining operation is aborted, if possible.

As specific methods for setting the rolling conditions and operating conditions for endless rolling and batch rolling, for example, a method disclosed in Japanese Unexamined Patent Publication No. 11-169926, filed by the present applicant, may be adopted. That is, Japanese Unexamined Patent Publication No. 11-169926 discloses a method in which, for example, a host computer determines beforehand both the rolling conditions for endless rolling and the rolling conditions for batch rolling for materials, such as slabs, to be subjected to endless rolling. When endless rolling becomes impossible, for example, a subordinate computer calculates the setting conditions for batch rolling of the devices based on the predetermined batch rolling conditions. Therefore, even if endless rolling is suddenly changed to batch rolling, there is no need to manually change the settings for all the devices one by one. For example, since the settings are changed by a one-touch operation, troublesome operations for changing the settings are eliminated. Moreover, it is possible to prevent operation trouble and defective coils due to faulty setting change and delay of setting change.

Figure 5:
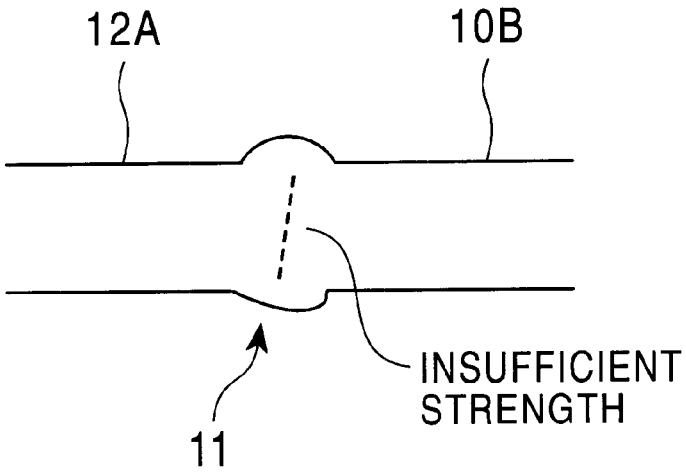
FIG. 5 is a cross-sectional view of a defective joint.

It is assumed that a situation arises to make the joining operation incomplete. For example, in the case of the joining unit 40 in which the end faces of the preceding metal block 10 and the succeeding metal block 12 are heated by applying current thereto by the inductor 43, and are joined by pressing, for example, melted portions of the metal blocks produced in the previous joining operation sometimes melt completely and remain inside the joining unit 40. As a result, if the remaining melted portions contact the current path and cause a short circuit during the next joining operation, so a sufficient current does not pass through the end faces of the metal blocks, the temperature increase is insufficient, and the joint strength between the preceding metal block 10 and the succeeding metal block 12 joined by pressing is not sufficient, as shown in FIG. 5.

Accordingly, when the joining operation is incompletely terminated, the joint is cut off in advance of finish rolling according to the present invention.

As the cutting means, for example, the crop shear 24 is suitably used, which is used to shape the leading and tail end of metal blocks even in conventional batch rolling which is distinct from continuous rolling. Of course, other cutting means may be used.

Figure 9:
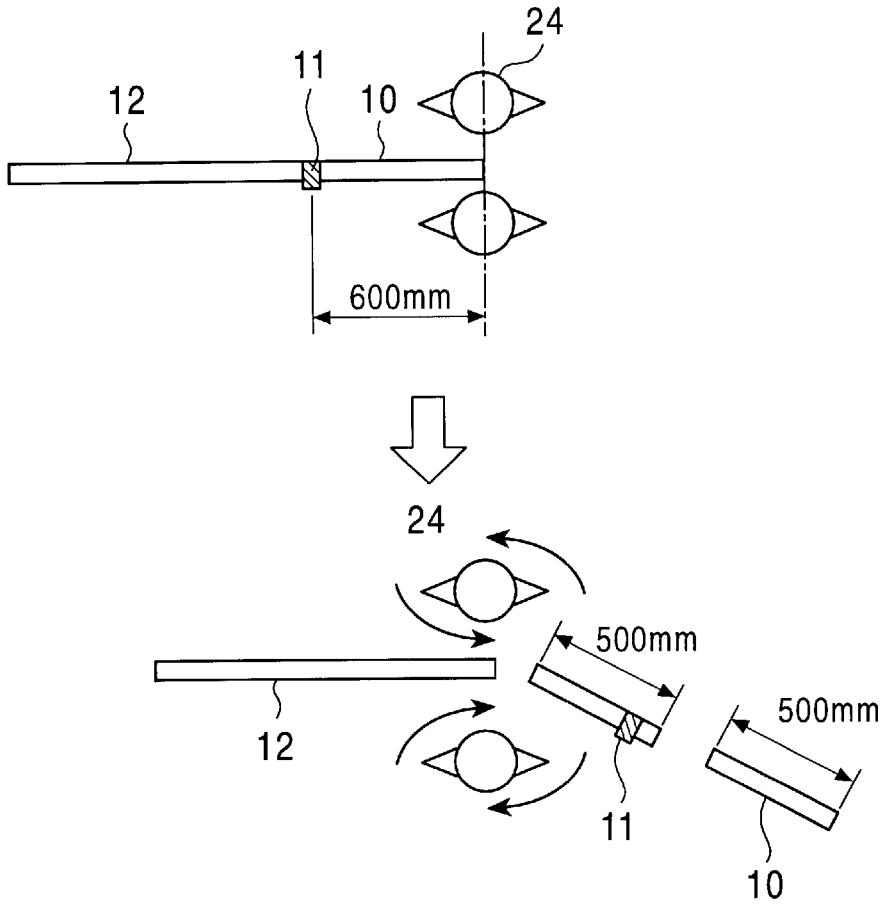
FIG. 9 is a front view showing a state in which a region including the joint is cut by a crop shear.

In order to cut the joint 11, a sheet bar cutting operation is performed by the crop shear 24 at least twice. If the joint cannot be adequately removed by the two cutting operations, the cutting operation is repeated until the joint 11 can be removed, as shown in FIG. 9.

After the joint is cut off, the preceding metal block 10 is subjected to finish rolling in an unchanged state because the leading end thereof has already been bitten in the finish-rolling unit 26.

In contrast, after the joint is cut off, the succeeding metal block 12 is subjected to rolling while the rolling schedule therefor is changed to a rolling schedule for the first block in endless rolling or to a rolling schedule for a batch-rolled material.

More specifically, when the target thickness of the preceding metal strip 12 after the joint is cut off is large enough for batch rolling, the preceding metal block 12 is rolled to the predetermined thickness.

Figure 7:
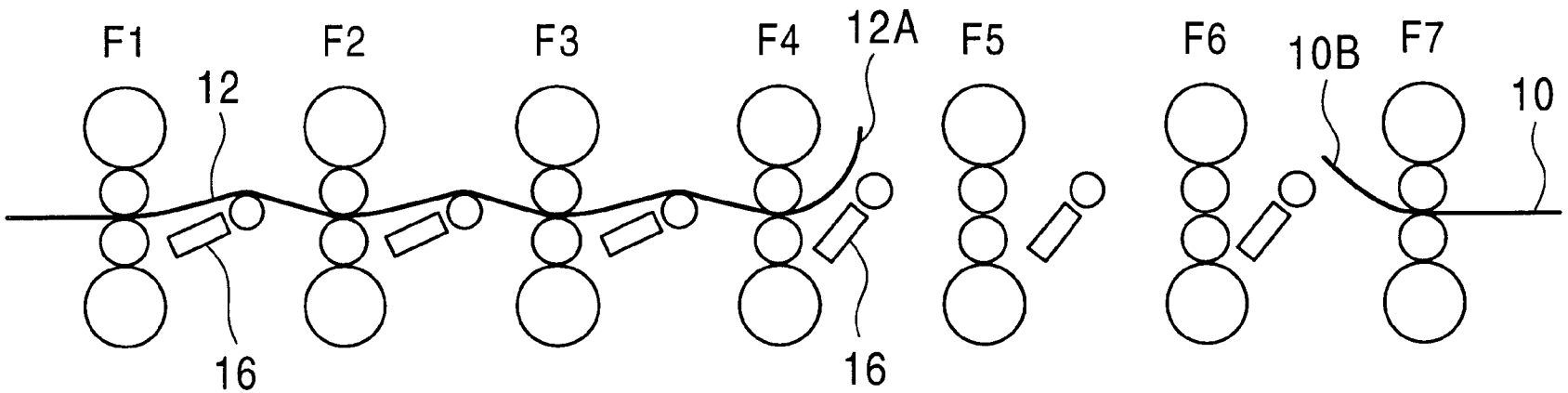
FIG. 7 is a front view showing a state in which the joint is broken in the finish-rolling unit.
Figure 10:
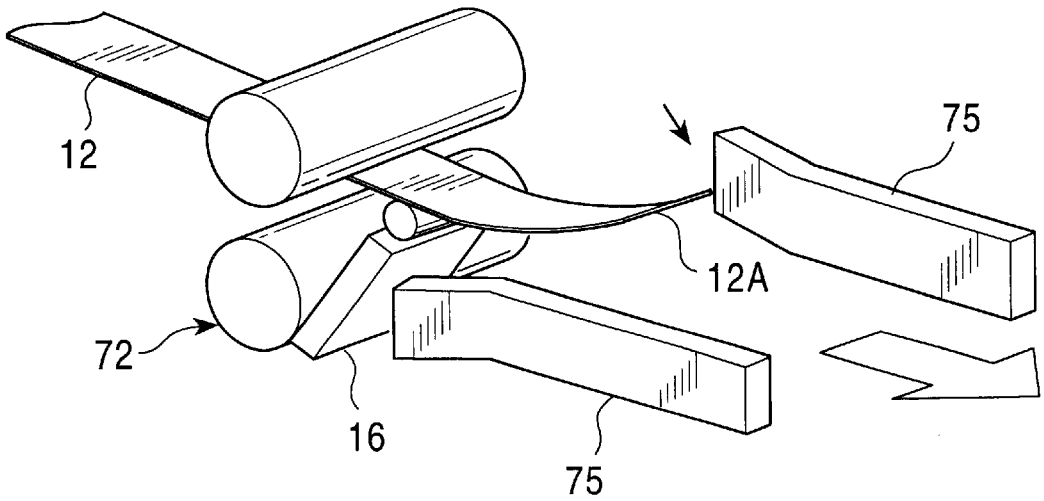
FIG. 10 is a perspective view showing a state in which the leading end of a metal sheet is sticking in a side guide.

In contrast, after the joining operation is aborted or after the joint is cut off, if the finished block thickness of the succeeding metal block 12 is, for example, less than 1.2 mm, which is sufficient for endless rolling, but is too small for batch rolling, according to the predetermined rolling schedule, batch rolling cannot be performed by the predetermined rolling schedule. This is because it takes ten or more seconds, or several tens of seconds in some cases, to set up the finish-rolling unit again for rolling the succeeding metal block after rolling the preceding metal block, the temperature of the succeeding metal block falls during this period, and the succeeding metal block becomes too hard to be rolled to the predetermined thickness. In general, as the thickness of the material decreases, the leading end 12A thereof is at a greater risk of meandering at any of the stands in the finish-rolling unit while threading therethrough, and of sticking in the side guide 75, as shown in FIG. 10. Numeral 16 in FIG. 10 denotes the looper described above in conjunction with FIG. 7.

In such a case, the succeeding metal block 12 is rolled while the rolling schedule therefor is changed to a rolling schedule for the first block in endless rolling or to a rolling schedule for a batch-rolled material. More specifically, rolling is performed while the settings of the finish-rolling unit are made so that the thickness of the finished strip throughout its length, or at least at the leading end, be equal to or more than, for example, 1.2 mm.

Furthermore, the second and subsequent succeeding metal blocks subsequent to the succeeding metal block 12 are rolled by a rolling schedule for the first metal block in endless rolling, a rolling schedule for the second and subsequent metal blocks in endless rolling, or a rolling schedule for a batch-rolled material.

That is, when the succeeding metal block 12, after the joining operation is aborted, serves as the first block in endless rolling, the second and subsequent metal blocks subsequent to the succeeding metal block 12 can be rolled by the predetermined rolling schedule in some cases, and cannot be rolled in others. For example, when the succeeding metal block 12, after the joining operation is aborted, serves as the first block in endless rolling, the finished thickness is reset to 1.2 mm or more for the above reason. The specific thickness, that is, the specific number of millimeters, sufficient for rolling varies depending on the variations in the period from when the joining operation is aborted until when the preparation for threading the succeeding metal block 12 is completed. For example, it is assumed that the finished thickness be reset to 2.3 mm. If the target thickness of the second succeeding metal block subsequent to the succeeding metal block 12 is 2.0 mm, since the amount of change in thickness from the first strip to the second strip is only 0.3 mm, there is no problem. However, when the target thickness of the second block is 1.2 mm, since the amount of change in thickness from the first strip to the second strip is no less than 1.1 mm, the thickness change is impossible because of, for example, the thickness change control capability of the finish-rolling unit in accordance with the traveling thickness change, as shown in FIG. 11. Accordingly, it is possible to select joining and rolling with the target thickness of the second strip changed to, for example, 1.6 mm (it is assumed that it is possible to cope with a change amount of 0.7 mm in thickness from 2.3 mm to 1.6 mm), or batch-rolling as a material of 1.2 mm without changing the thickness.

The third and subsequent metal blocks are similarly joined and rolled when the target finished thickness thereof can be achieved in continuous hot finish rolling within the traveling thickness change control capability, and, if this is impossible, they are rolled as batch-rolled materials.

The traveling thickness change control capability is determined by the speed of response of a speed control system and a tension control system to the rate of change in the product of block thickness and rolling speed (volume velocity) (to what degree the breakage of strips due to a sudden increase in tension or, conversely, the loosening and waving of the block due to a decrease in tension can be prevented), and by the shape control capability.

Furthermore, after the joining operation is aborted, the devices concerned with joining (the joining unit 40 and the treatment unit 50) are brought into a roll-up state that allows the leading end of the first block in endless rolling or of the batch-rolled material to be threaded therethrough. After the operation is completed, the leading end of the succeeding metal block, after the joining operation is aborted, is allowed to be threaded through the devices.

When the joining operation is aborted, since the preceding metal block 10 and the succeeding metal block 12 must be rolled separately, the succeeding metal block 12 is stopped or decelerated. The leading end of the preceding metal block 10 has been already rolled by the finish-rolling unit 26 in most cases, and therefore, rolling by the finish-rolling unit 26 is continued unchanged. Since thin materials are in danger of pinching when it moves out of the finish-rolling unit, the thickness of the tail end thereof may be increased.

The joining device 40 may be stopped by automatic positioning control (APC) at a position such that the relative positional relationship to the lifting table rollers 66 is appropriate, or the joining unit 40 may be moved in synchronized velocity with the preceding metal block 10 to some extent, be decelerated slightly before a position that allows an appropriate relative relationship, and be stopped at an appropriate position while the succeeding metal block 12 is immediately stopped. The joining unit 40 may be temporarily stopped in synchronized velocity with the succeeding metal block 12, and be moved to and stopped at a position such that the relative relationship is appropriate.

Incidentally, the joining unit 40 is temporarily stopped in synchronized velocity with the succeeding metal block 12 in the following embodiment. In this case, it is assumed that the succeeding metal block 12 does not become too hard to be rolled due to a decrease in temperature even in consideration of the time necessary for temporarily stopping the succeeding metal block 12, completing block threading condition setting operations of the joining unit 40 and the treatment unit 50 (which will be described later), restarting the feeding of the succeeding metal block 12, and finish-rolling the succeeding metal block 12. After the preceding metal block 10 moves downstream from a lifting table zone, the operations of setting the threading conditions for the succeeding metal block 12 and subsequent metal blocks are performed.

Figure 12:
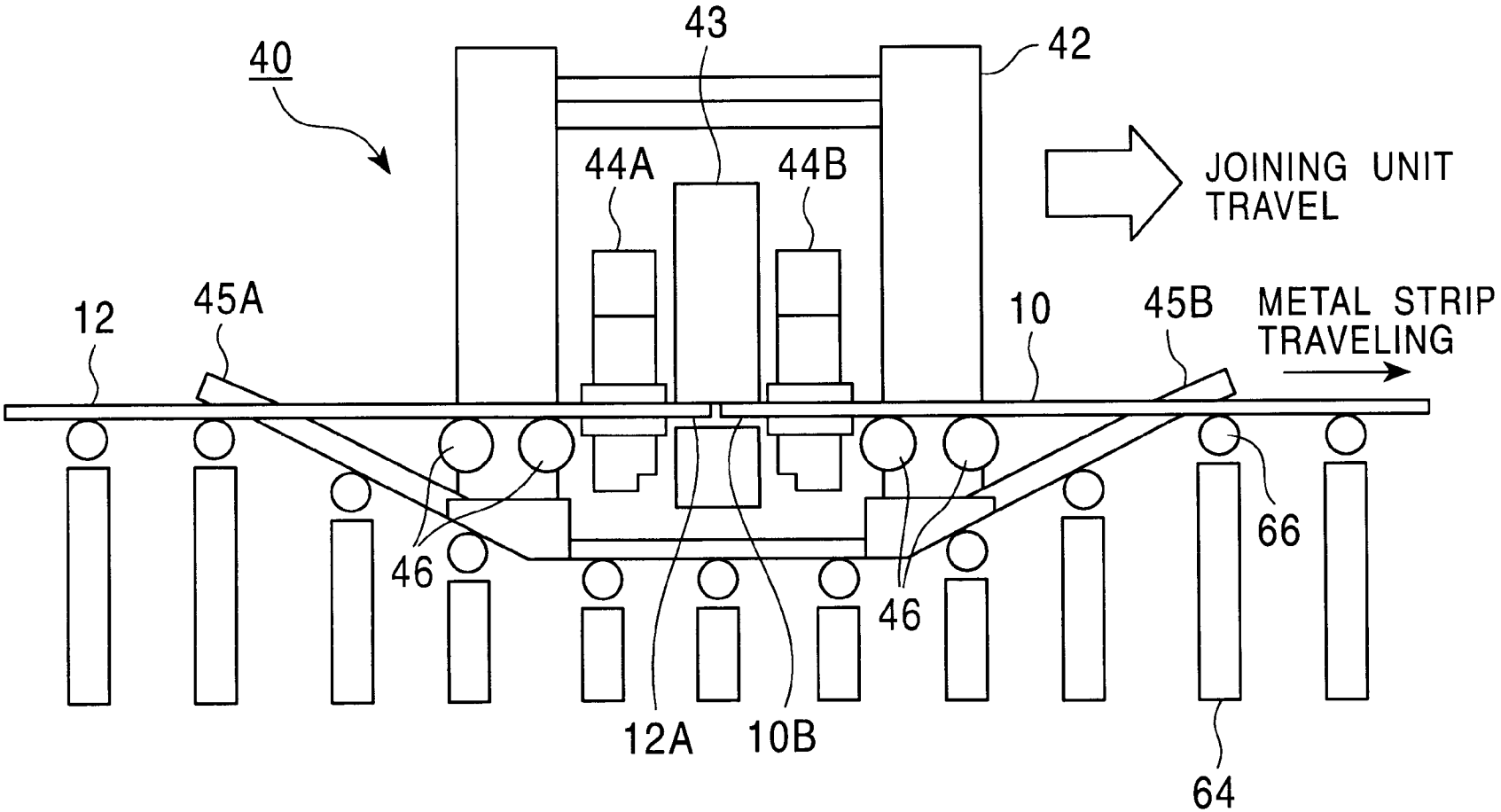
FIG. 12 is a front view of the joining unit in which joining and rolling are being performed successfully.

A method for setting the conditions for threading the succeeding metal block 12 and subsequent metal blocks, after the joining operation of the joining unit 40 is stopped, will be described in conjunction with, for example, a derivative of the joining unit proposed in Japanese Unexamined Patent Publication No. 7-1007 (the table pressing guides 45A and 45B on the inlet side and the outlet side of the joining device are movable up and down). In a state in which a joining operation is being performed successfully, the joining unit 40 is moving with the table pressing guides 45A and 45B in the down position, as shown in FIG. 12.

As described above, when the joining operation is aborted, the movement of the joining unit 40 is also stopped, and the feeding of the succeeding metal block 12 is temporarily stopped or decelerated.

Figure 13:
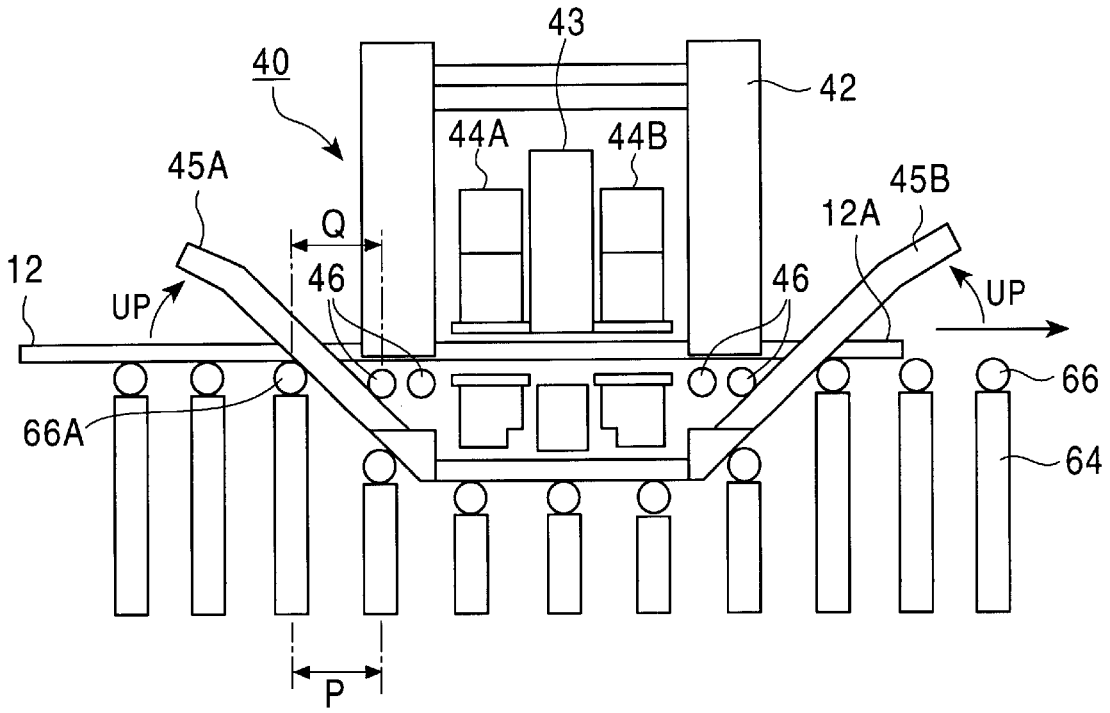
FIG. 13 is a front view showing a normal state of the joining unit in which the leading end of the succeeding metal block is threaded therethrough when the joining operation is aborted.

After the feeding is temporarily stopped, as shown in FIG. 13, the table pressure guides 45A and 45B are raised, and the clamps 44A and 44B and the inductor 43 are placed in an up (open) state. After the operation is completed, the succeeding metal block 12 and subsequent metal blocks are threaded therethrough.

Figure 14:
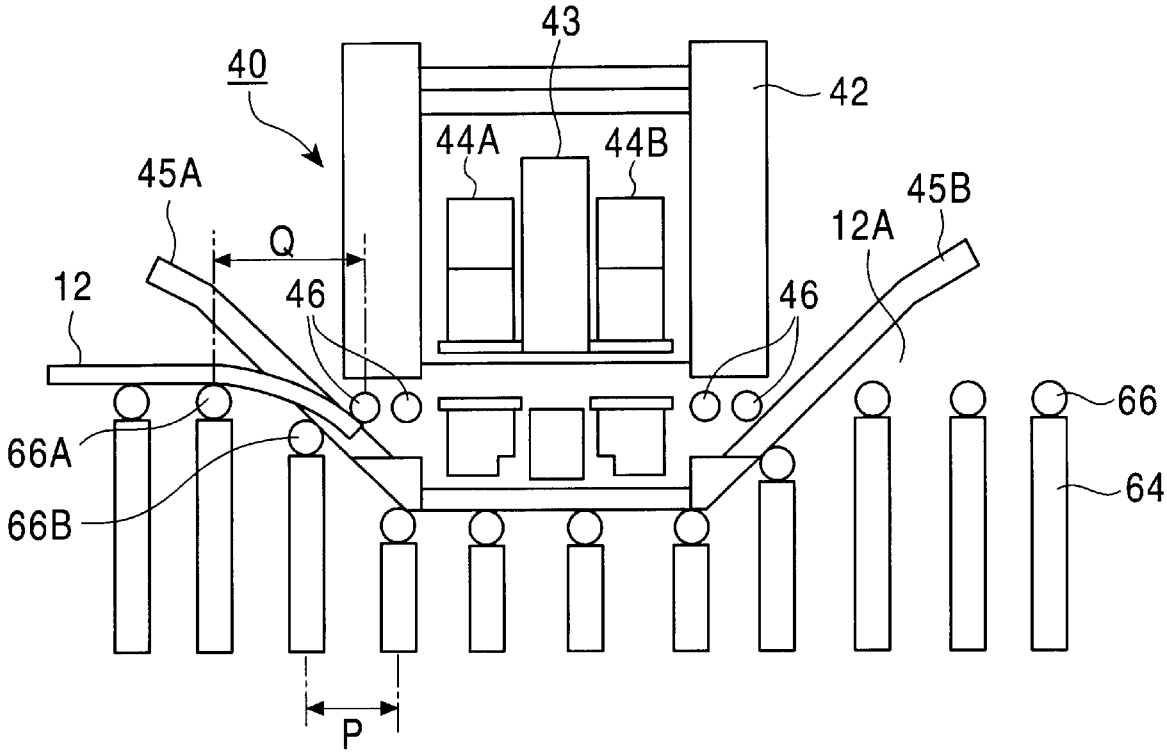
FIG. 14 is a front view showing a state in which the leading end of the succeeding metal block is threaded therethrough when the stop position of the joining unit is inappropriate.

Regarding the relative relationship between the travel stopping position of the joining unit 40 and the position of the lifting table in this case, for example, when the joining unit 40 stops in an appropriate state in which the space Q between the lifting rollers 66A at the upper limit position and the rollers 46 of the joining unit is equal to or less than the distance P between the lifting rollers 66, as shown in FIG. 13, there is no problem. In contrast, if the positional relationship is inappropriate and any of the lifting rollers 66B does not ascend to the upper limit position, for example, as shown in FIG. 14, the space Q between the lifting roller 66A at the upper limit position and the roller 46 of the joining unit is wide. When the leading end 12A of the succeeding metal block is threaded in that state, it falls and slips into the space and cannot be further threaded. Accordingly, the joining unit 40 is ideally stopped so that the joining unit 40 and the lifting rollers 66A be in the relationship shown in FIG. 13. The maximum allowable space Q is 1.5 times the lifting roller pitch P.

When the succeeding metal block is not stopped, but is simply decelerated after the joining operation is aborted, the joining unit is stopped at a position that allows an appropriate relative relationship, and the succeeding metal block is decelerated to a feeding speed such that the leading end thereof is put into the joining unit after the upward movement of the table pressing guides 45A and 45B is completed.

A method for setting the conditions of the treatment unit 50 for threading the succeeding metal block 12 and subsequent metal blocks, after the joining operation is aborted, will now be described in conjunction with, for example, the treatment unit proposed in Japanese Unexamined Patent Publication No. 9-29528. That is, in a state in which a joining operation is being performed successfully, the pressing-down device 51 and the pressing-up device 53 are in the cutting position, the openable and closeable apron 55 is open, as shown in FIG. 15, and the rotary cutters 52 and 54 are rotating at a high speed (for example, at a peripheral speed of 80 to 100 m/s) in the reverse direction opposite from the metal block feeding direction.

Figure 16:
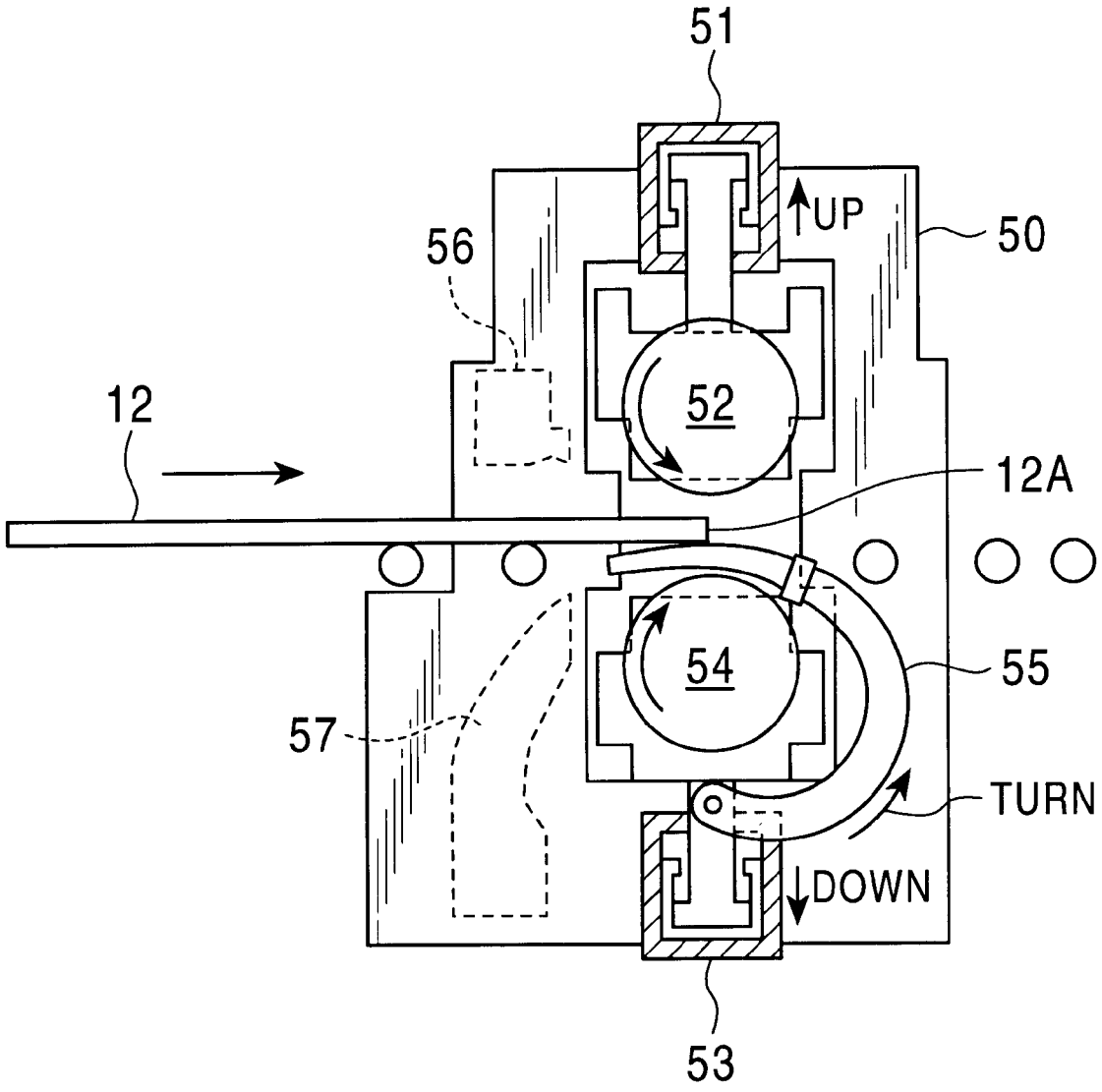
FIG. 16 is a front view of the treatment unit in which the leading end of the succeeding metal block is threaded therethrough when the joining operation is aborted.

When the joining operation is aborted, the traveling of the joining unit 40 is temporarily stopped, and the feeding of the succeeding metal block 12 is temporarily stopped or is decelerated. In this case, the pressing-down device 51 and the pressing-up device 53 are released, and the openable and closeable apron 55 is closed in the treatment unit 50, as shown in FIG. 16. Furthermore, the rotary cutters 52 and 54 are rotated in the forward direction the same as the metal block feeding direction at a speed substantially equal to the metal block feeding speed. This allows the metal blocks to be smoothly threaded there through.

Figure 17:
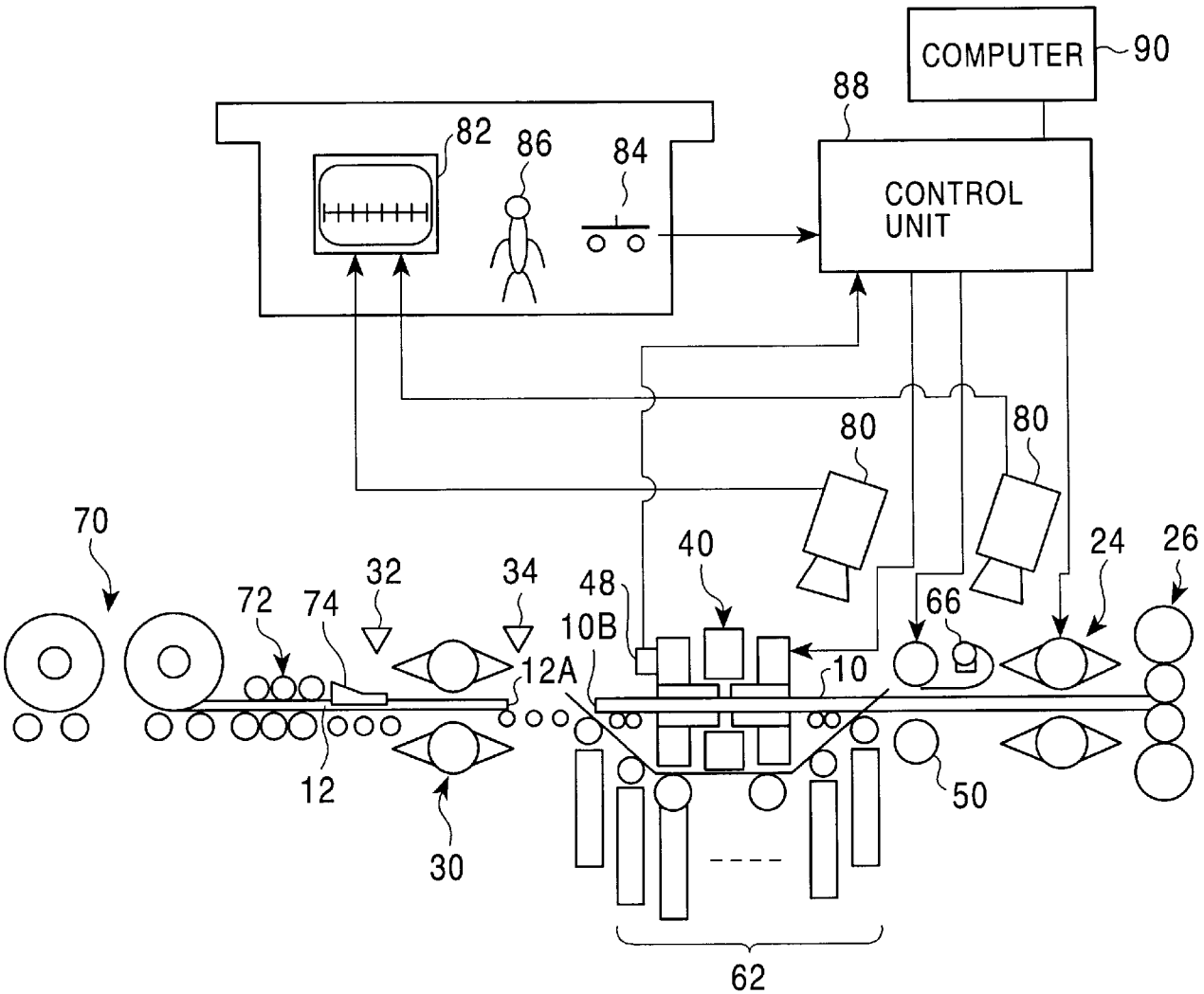
FIG. 17 is a front view showing the overall configuration of an embodiment of the present invention, including a block diagram.

FIG. 17 shows the overall configuration in this embodiment. In the figure, numerals 80, 82, 84, 86, 88, and 90 denote, respectively, TV cameras for monitoring, a monitor, various pushbuttons, an operator, a control unit, and a host computer.

Figure 18:
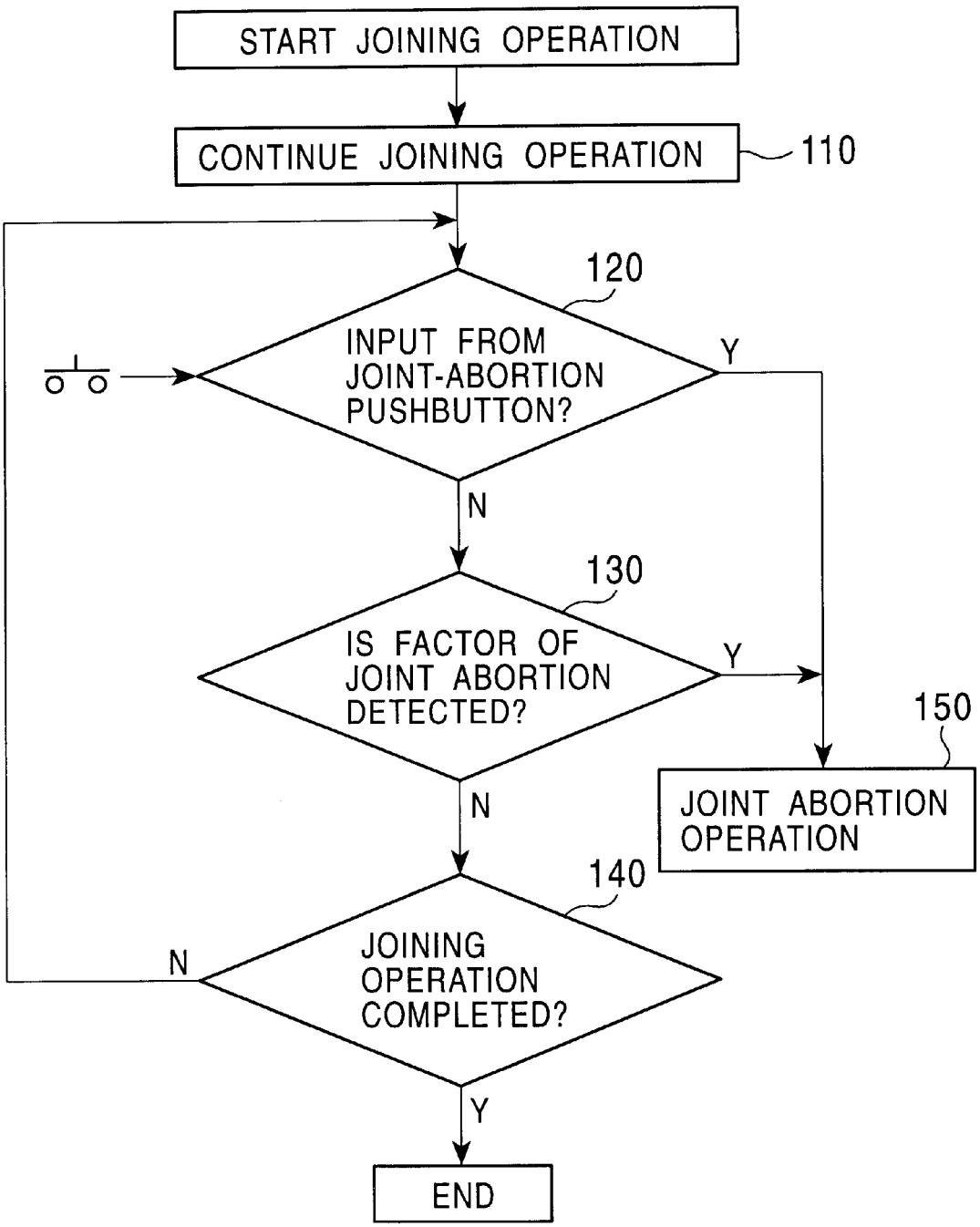
FIG. 18 is a flowchart showing the procedure for determining whether or not to abort joining according to the embodiment of the present invention.

In this embodiment, a control system is constructed, as shown in FIG. 18, so that the abortion of the joining operation can be determined by means of both (1) the logic in the control unit (Step 130), and (2) the pushbutton input at the discretion of the operator (Step 120).

(1) An example is given of logic that automatically determines the abortion of the joining operation inside the control unit 88. For example, when the condition is satisfied that the metal block detection device 32 on the inlet side of the joining crop shear 30 is not brought into the ON state by the leading end 12A of the succeeding metal block after the tail end 10B of the preceding metal block is threaded through the joining crop shear 30 and the metal block detection device 34 on the outlet side of the joining crop shear is brought into the OFF state, it is determined that the following feeding of the leading end A of the succeeding metal block is delayed for some reason and that the joining operation should be aborted.

(2) An example is given of a case in which pushbutton input is needed at the discretion of the operator. For example, although the joining crop shear 30 has cut the air when cutting the tail end or leading end of the metal block, the control unit 88 determines that cutting has been performed successfully. In this case, the control unit 88 must be instructed to abort the joining operation, through the pushbutton input at the discretion of the operator 86 who is monitoring the images on the TV cameras 80 through the monitor 82 (Step 150).

The abortion of the joining operation is not determined only by the means (1) and (2) for determining whether the joining operation itself can be carried out. It is also possible to detect trouble, such as a breakdown of the devices concerned with endless rolling (the devices that is indispensable to endless rolling, for example, the joining unit, the treatment unit, and the strip shear), and to use the detection as a criterion for determining the abortion of the joining operation.

The above determination as to whether or not the joining operation is aborted must be made before the joining unit starts a joining start operation. That is, the determination is made before pressing the tail end 10B and the leading end 12A in the above embodiment.

While the present invention is applied to the hot rolling system including the joining unit for performing heating and joining using the inductor in the above-described embodiment, the present invention is not applicable only to this hot rolling system. The present invention is also applicable to a hot rolling system including a joining unit in which the tail end 10B and the leading end 12B are abutted and joined by, for example, laser welding. In the case of a joining unit using laser welding, the tail end 10B and the leading end 12A are abutted, and then heating at a metal block joint is performed by a laser. Therefore, the determination as to whether or not the joining operation is aborted is made before starting the heating by the laser.

While the present invention is applied to the hot rolling system including the treatment unit 50 placed on the outlet side of the joining unit 40 so as to remove burrs at the joint in the above embodiment, it is, of course, applicable to a hot rolling system including a treatment unit for pushing burrs into the metal strip, or a hot rolling system having no treatment unit.

There is another problem regarding feeding carried out without any trouble, such as sticking, even when an incomplete joint having insufficient strength is broken before being cut.

Accordingly, in the present invention, the incomplete joint between the preceding metal block and the succeeding metal block is fed in synchronized velocity with the movement of the joining unit, the joining unit moves to the downstream end of the travel zone and stops there, and the preceding metal block and the succeeding metal block are not stopped, but are fed unchanged at the feeding speed of the preceding metal block whose leading end has already been rolled by the finish rolling unit.

The operations in this case will be described in conjunction with the joining unit (as shown in FIGS. 12 and 13, the joining unit 40 moves while sequentially depressing the lifting table rollers 66 in a state in which the table pressing guides 45A and 45B on the inlet and outlet sides of the joining unit 40 are in the low position) proposed in Japanese Unexamined Patent Publication No. 7-1007 as an example.

Figure 8:
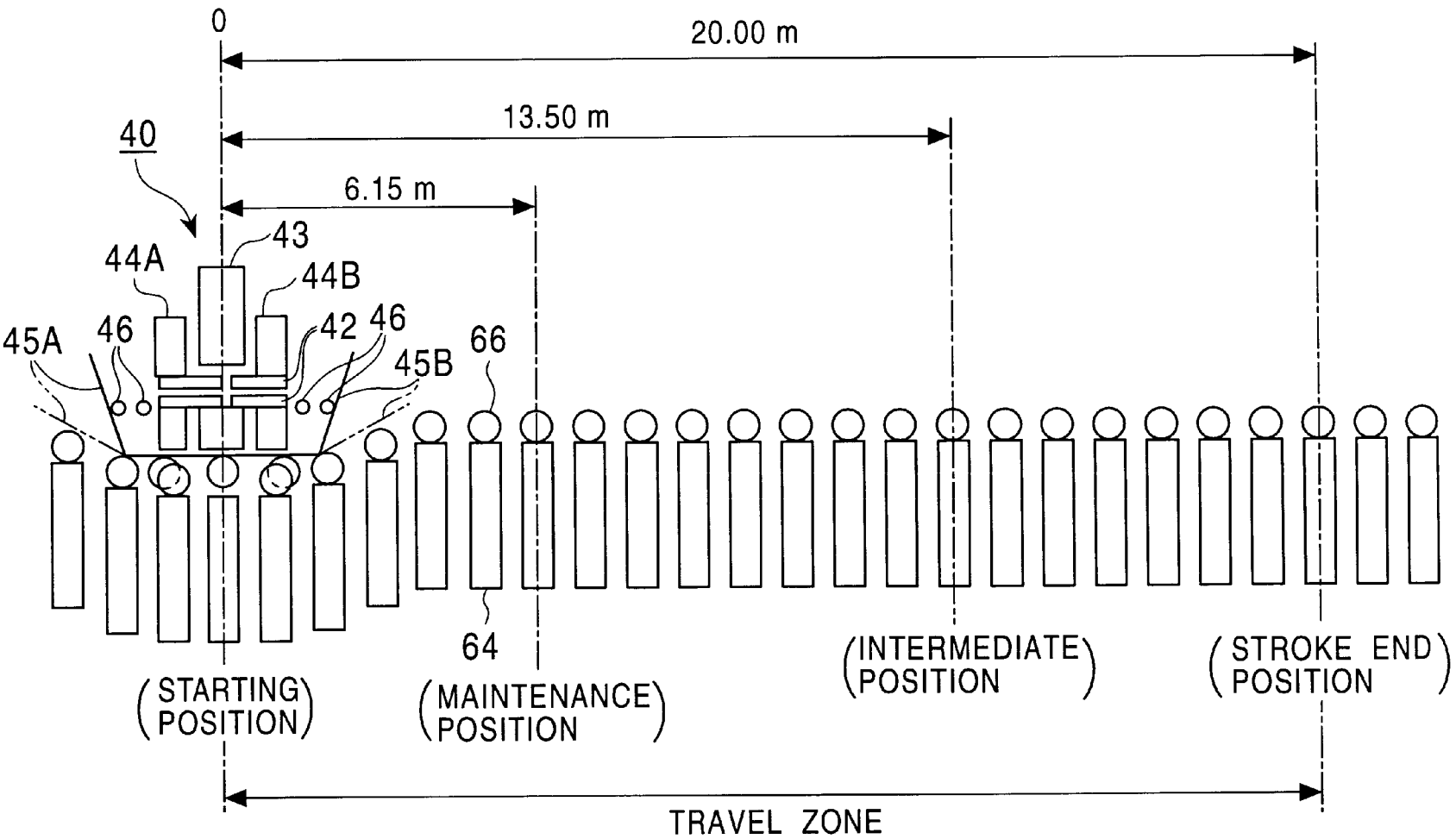
FIG. 8 is a front view showing the stop positions of a joining unit used in the continuous hot rolling.

When an incomplete joint is thus formed during the movement of the joining unit 40, if the movement of the joining unit 40 is temporarily stopped, in a manner similar to that in the normal operation when the joining has been performed successfully (in the normal operation, after joining, the joining unit 40 temporarily stops after releasing the clamps, and returns to the starting position shown in FIG. 8 for the next joining operation), the incompletely joined joint is fed downstream from the joining unit 40.

Figure 19:
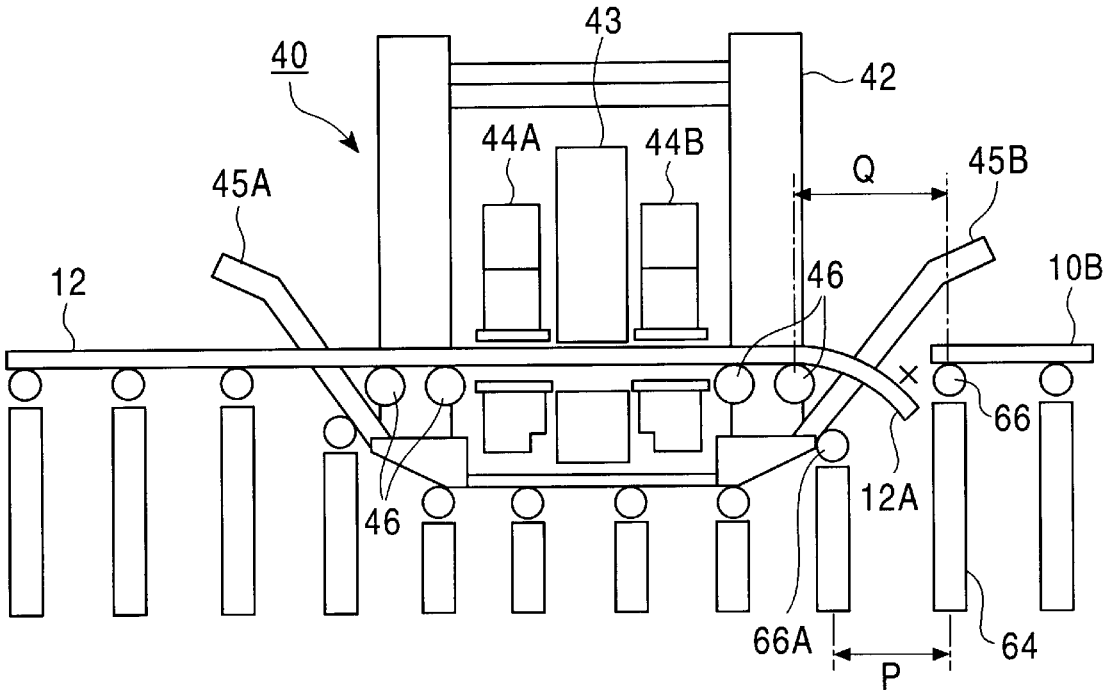
FIG. 19 is a front view showing a state in which the leading end of the succeeding metal block is threaded when the stop position of the joining unit is inappropriate.

Then, in a case in which the joint 11 is broken just when it begins to move from the joining unit 40 to the immediate downstream side, the leading end 12A of the succeeding metal block after breaking bends downward, and falls into the space Q between the lifting table rollers, as shown in FIG. 19.

Such a space is formed because of an inappropriate relative relationship between the travel stop position of the joining unit 40 and the lifting position of the lifting table rollers. That is, as shown in FIG. 13, when the joining unit 40 is stopped at a position such that an appropriate span Q is formed between the rollers 46 on the joining unit 40 and the lifting table rollers 66 immediately upstream and downstream from the joining unit 40, the span Q can be made substantially equal to the pitch P of the lifting table rollers 66. However, when the positional relationship is not appropriate, that is, when some of the lifting table rollers 66A are not in the upper limit position, as shown in FIG. 19, a span Q longer than the pitch P of the lifting table rollers is formed. It is preferable to stop the joining unit 40 so that the span Q range from 0.5 P to 1.5 P.

Theoretically, a stop position of the joining unit, so as not to form the table gap when the table pressing guides are raised, lies at every pitch of the lifting table rollers. Therefore, it is possible to perform an operation of stopping the movable truck 42 at the position and an operation of raising the table pressing guides 45A and 45B. For ease, several positions may be determined, as shown in FIG. 8. However, there remains a possibility that the leading end 12A of the succeeding metal block will fall in the table space during that operation. This is because the feeding of the preceding metal block 10 and the succeeding metal block 12 is continued even during the ascending operation of the table pressing guides.

Figure 20:
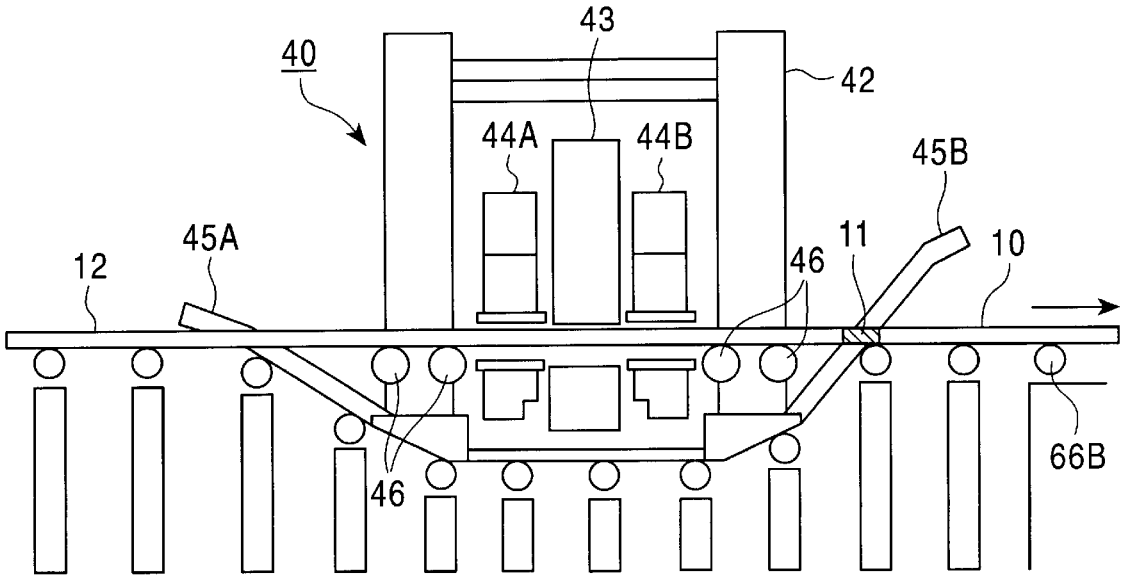
FIG. 20 is a front view showing a state immediately before the joint is transferred onto a table on the outlet side of the joining unit without any trouble.

When the movable truck 42 stops at the joining unit stop position so as not to form a table gap and the operation of raising the table pressing guides 45A and 45B is performed sufficiently promptly so that the table gap be closed before the leading end 12A of the succeeding metal block reaches that position, the joining unit 40 is stopped at a position, downstream from and closest to the position of the joining unit when the incomplete joint is formed, such that the table space do not exceed 1.5 P, as shown in FIG. 20. Then, at least the table pressing guide 45B on the downstream side (on the outlet side of the joining unit 40) is raised.

Figure 21:
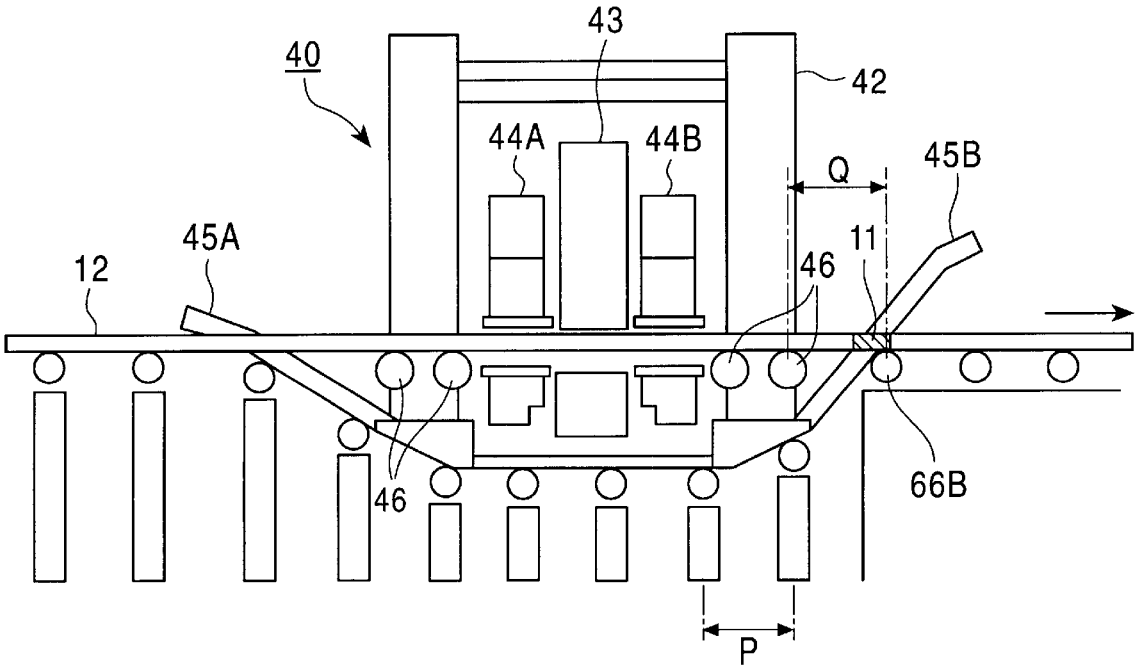
FIG. 21 is a front view similarly showing the state of transfer.

When the table space cannot be closed before the leading end 12A of the succeeding metal block arrives there because the operation of raising the table pressing guide 45B has not been completed, the joining unit 40 moves in synchronized velocity with the incomplete joint, and stops at the downstream end of the travel zone. Regarding the table pressing guides of the joining unit 40 in this case, at least the table pressing guide 45B on the downstream side (on the outlet side of the joining unit 40) is raised, as shown in FIG. 21, and the span Q between the roller 46 of the joining unit 40 and the roller 66B on the most upstream side in the outlet-side part of the joining unit travel zone is set to have a relationship with the pitch P between the table rollers such the formula $0.5\ P \leqq Q \leqq 1.5\ P$ is satisfied.

The preceding metal block 10 and the succeeding metal block 12 are not stopped at that time, and are fed in an unchanged state at the feeding speed of the preceding metal block whose leading end has already been rolled by the finish-rolling unit 26.

It is determined whether the operation of raising the table pressing guide 45B is completed before the leading end 12A of the succeeding metal block reaches the table space, depending on the equipment capacity of the actuator for raising the table pressing guide 45B and the feeding speed of the succeeding metal block 12.

Figure 15:
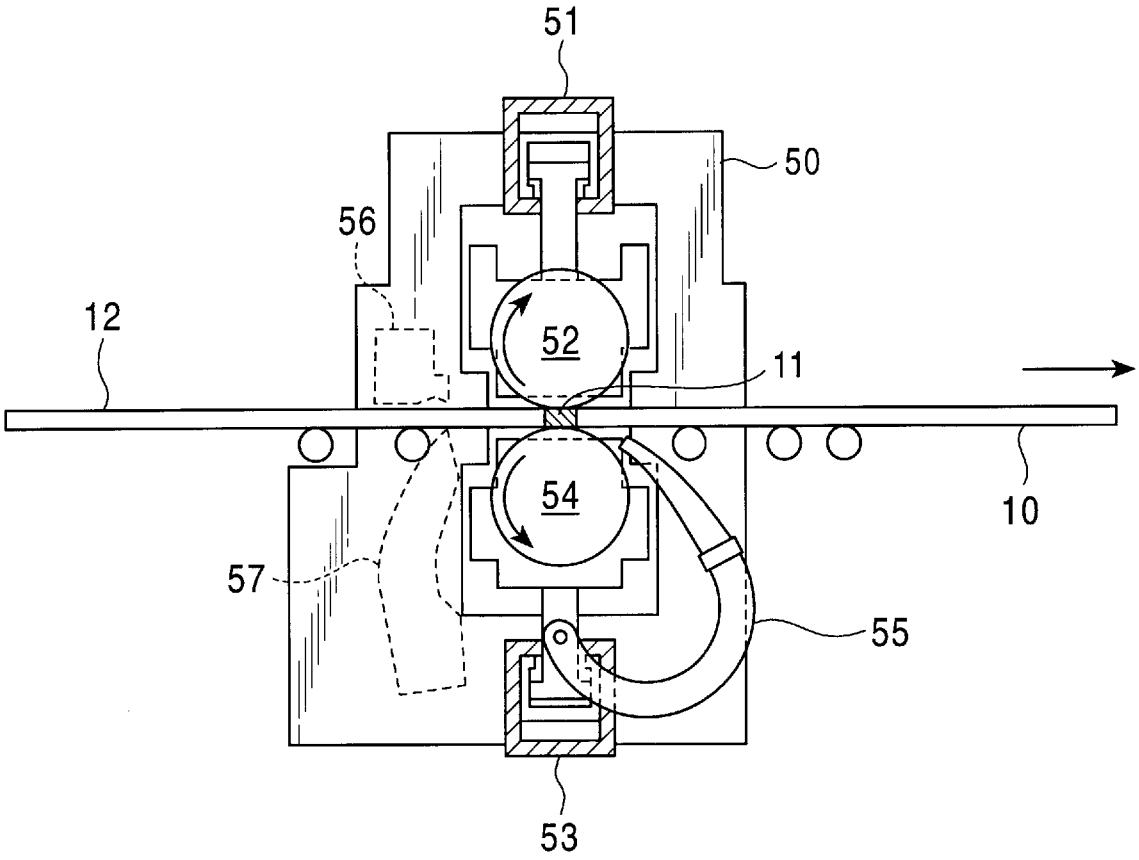
FIG. 15 is a front view of a treatment unit when joining and rolling are performed successfully.
Figure 22:
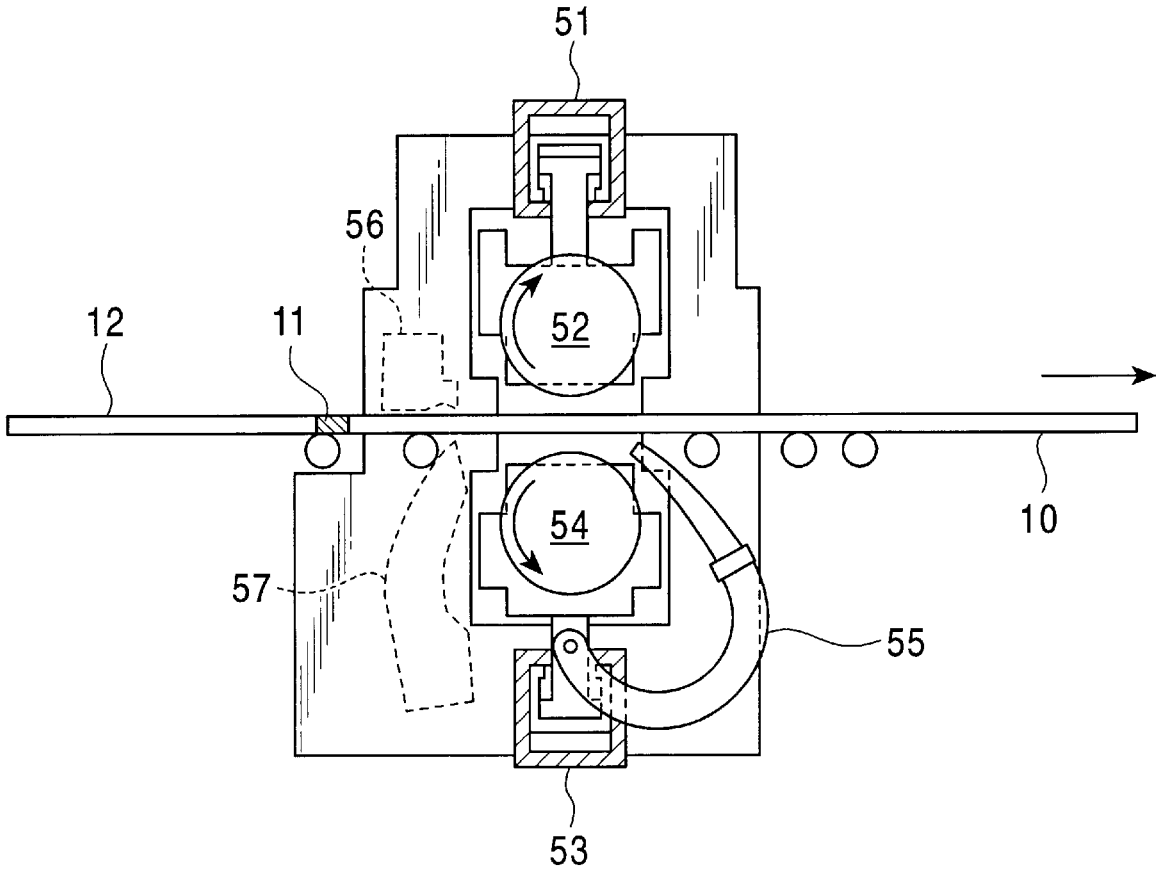
FIG. 22 is a front view of the treatment unit in a cutting preparation state.

When the treatment unit 50 is constructed by a deburring device for removing burrs produced at the joint, if burrs at the incomplete joint between the preceding metal block and the succeeding metal block are removed in the conventional manner, as shown in FIG. 15, tensile force acts from the rotary cutter 54 toward the metal block joint 11 in the direction to separate the joint, and therefore, the joint 11 may be broken. Accordingly, it is preferable to stop removing the defective joint portion when the incomplete joint is detected. More specifically, the rotary cutters 52 and 54 are retracted to the cutting standby positions, as shown in FIG. 22. If possible, the rotary cutters 52 and 54 are completely released, and the openable and closeable apron 55 is closed, as shown in FIG. 16.

FIG. 17 shows the overall configuration in this embodiment. In the figure, numeral 48 denotes a displacement gauge for detecting the displacement of the preceding metal block and the succeeding metal block when the metal blocks are pressed, numeral 80 denotes TV cameras for constantly taking pictures of the state of the joint 11 after joining during operation, numeral 82 denotes a monitor for displaying, for an operator 86, pictures of the state of the joint 11 after joining taken by the TV cameras 80, numeral 84 denotes a joint-cut pushbutton for use in cutting the joint at the discretion of the operator 86, numeral 88 denotes a control unit, and numeral 90 denotes a host computer.

The two TV cameras 80 are respectively installed at two positions on the outlet side of the joint 11 and on the inlet side of the crop shear 24, and are selectively used according to the feeding position of the joint 11.

The screen of the monitor 82 is provided with graduations such that the distance from the cutting position to the joint 11 can be known when cutting the joint 11.

The joining unit 40, the treatment unit 50, the crop shear 24, the joint-cut pushbutton 84, and all the devices to be controlled are connected to the control unit 88, and these devices are controlled by the control unit 88.

Figure 23:
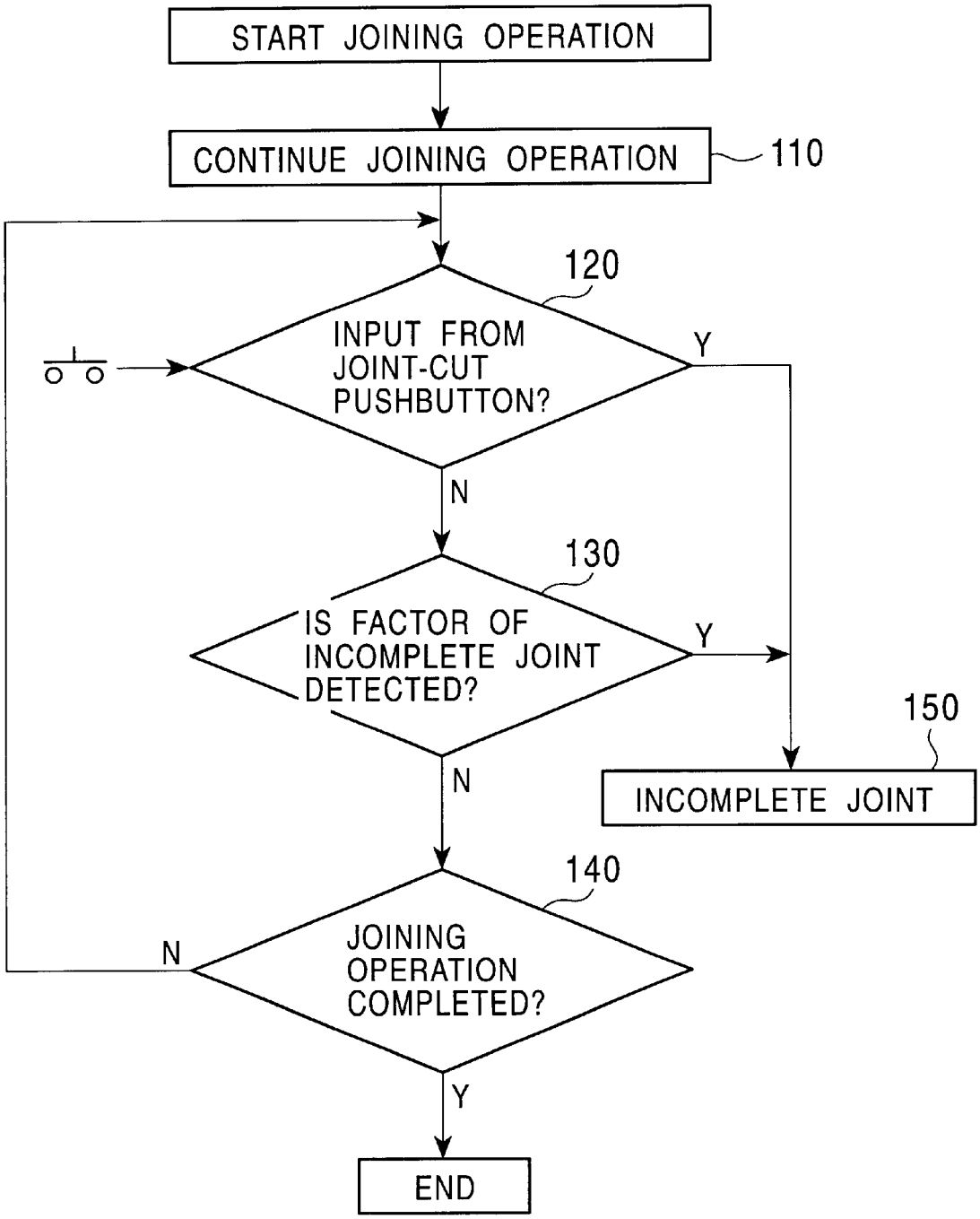
FIG. 23 is a flowchart showing the procedure for determining that the joint is incomplete, according to the embodiment of the present invention.

In this embodiment, the control system is constructed, as shown in FIG. 23, so that the defective joint be determined by means of both (1) the logic in the control unit 88 (Step 130) and (2) the pushbutton input at the discretion of the operator (Step 120).

(1) An example is given of the logic that automatically determines cutting of the joint inside the control unit 88. For example, in the case of a joining method in which the end faces of the metal blocks are heated and pressed against each other, if the heating temperature does not reach an appropriate temperature, the metal blocks, which are harder than desired, are pressed at a lower temperature than desired because of insufficient temperature increase, and the amount of displacement by pressing is smaller than desired. Therefore, the displacement by pressing is calculated beforehand by predictive calculation, and the decreased displacement amount is detected by the displacement gauge 48. Conversely, when the amount of displacement by pressing is greater than desired, a melted through hole might be formed due to an excessive increase in heating temperature, and it can also be determined that joining is incomplete (Step 130). When it is determined that joining is incomplete, the joint 11 is cut (Step 150).

(2) An example is given of a case in which pushbutton input is needed at the discretion of the operator. For example, the TV cameras 80 are installed in the joining unit 40, and the operator 86 constantly monitors the state of the joint 11 by watching the images on the monitor 82 during operation. In a case in which the operator finds a hole melted completely at the joint 11, although it has not been determined by the automatic determination logic_that joining is incomplete, an operation of cutting the joint is carried out (Step 150) by pressing the joint-cut pushbutton 84 (Step 120).

A metal block subsequent to the succeeding metal block may be subjected to joining and endless rolling, and may be subjected to batch rolling. In the case of batch rolling, the joining unit 40 and the treatment unit 50 must be placed into a state that allows the leading end of the subsequent metal block to be threaded therethrough. Description will given below of a method of threading the leading end of the subsequent metal block.

After the incomplete joint 11 between the preceding metal block 10 and the succeeding metal block 12 moves downstream from the travel zone of the joining unit 40, the joining unit 40 and the treatment unit 50 operate to allow the subsequent metal block to be threaded therethrough. For example, the joining unit 40 moves to the maintenance position shown in FIG. 8, raises the table pressing guides 45A and 45B, and moves the clamps 44A and 44B and the inductor 43 to the up (open) position, as shown in FIG. 13. The devices are designed so that the relative relationship between the travel stop position of the joining unit 40 and the position of the lifting table 66 be appropriate in this state, as shown in FIG. 13. In this state, the preparation for feeding the subsequent metal block is completed.

In contrast, in the treatment unit 50, after a certain period has passed from the cutting standby position (cutting preparation state) shown in FIG. 15, the pressing-down device 51 and the pressing-up device 53 are released, as shown in FIG. 22, and the openable and closeable apron 55 is closed, as shown in FIG. 16. It is more preferable to rotate the rotary cutters 52 and 54, which were rotating in the opposite direction from the feeding direction in the cutting preparation state, in the forward direction the same as the material feeding direction at the peripheral speed substantially equal to the material feeding speed (180 mpm when the rotary cutter diameter is 950 mm and the rotation speed is 60 rpm). This is for feeding the leading end of the succeeding block in the feeding direction if the succeeding metal block is bended upward and contacts the rotary cutters. Incidentally, the speed at which the succeeding metal block is fed until it is bitten by the finish-rolling unit is set at 150 mpm.

When the joint is threaded through the treatment unit 50, if the treatment unit 50 has already been placed into the state shown in FIG. 16, it remains in that state.

As described above, just when the joining devices are shifted to a state such that the leading end of the succeeding metal block can be threaded therethrough, the succeeding metal block is threaded. The feeding of the succeeding metal block may be restarted just when the joining devices are shifted to a state such that the leading end of the succeeding metal block can be threaded therethrough, or may be restarted somewhat earlier than the threading enabling state will be brought about. The succeeding metal block may be temporarily stopped until the feeding is restarted, or may be on oscillation standby, that is, it may move back and forth so that the temperature do not locally fall only in the portion in contact with the roller. The succeeding metal block may be fed at a substantially low speed while the joining devices are shifting to the leading end threading state.

EXAMPLE 1

It is assumed that an operation of joining the tail end of the second block and the leading end of the third block of four blocks to be joined was aborted during endless rolling (the first is a low-carbon steel block of 1.2×1000 mm, the second is a low-carbon steel block of 1.0×1000 mm, the third is a low-carbon steel block of 1.0×1000 mm, and the fourth is a low-carbon steel block of 1.2×1000 mm).

Figure 24:
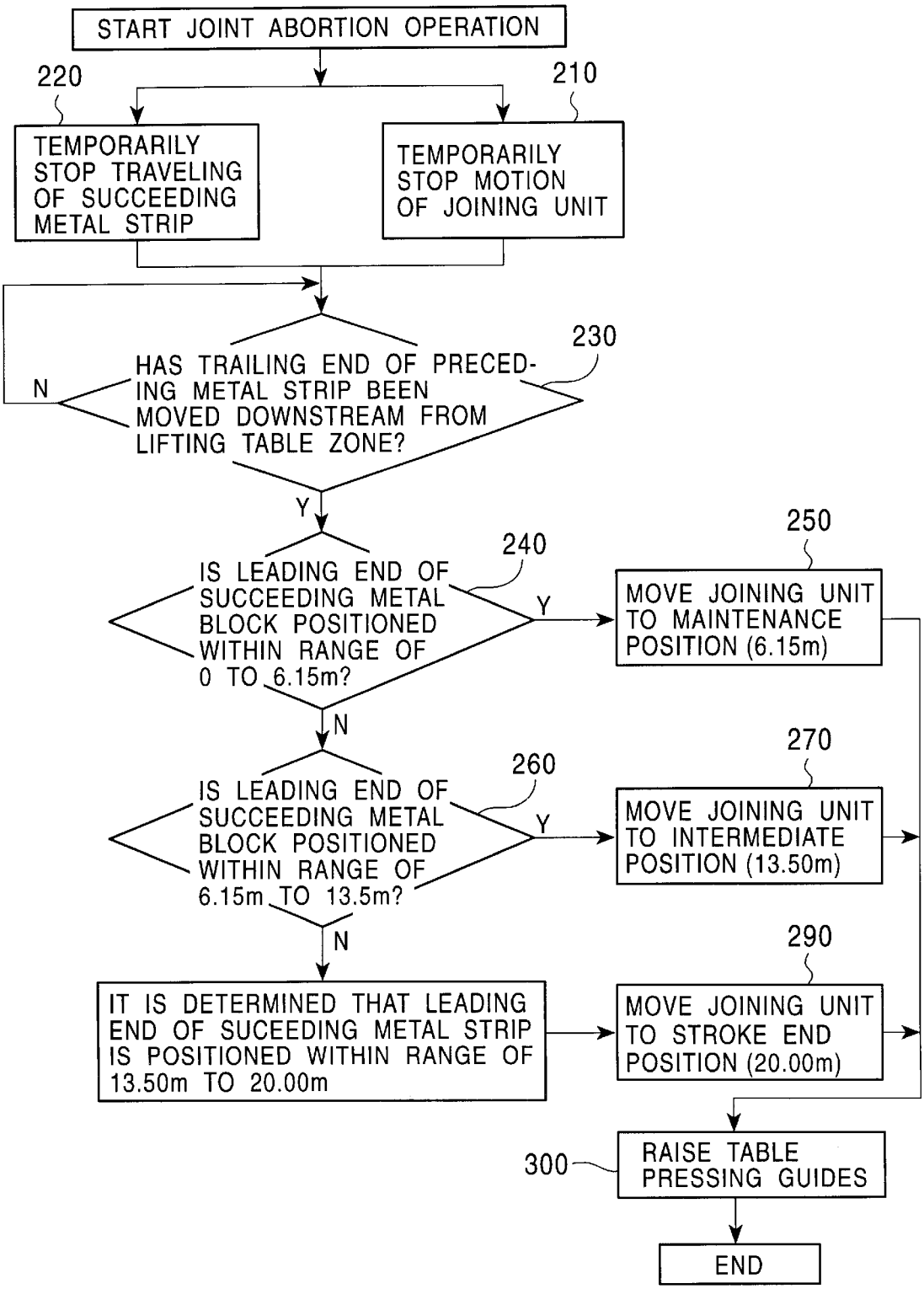
FIG. 24 is a flowchart showing the procedure for determining the stop position of the joining unit.

When the joining operation is aborted, the travel of the joining unit 40 and the feeding of a succeeding metal block 12 are temporarily stopped in synchronized velocity. It is assumed that the leading end 12A of the succeeding metal block (third) stop at a position 1.5 m shifted from the starting position (reference position) in the travel zone of the joining unit 40 when the joining operation is aborted, as shown in FIG. 8. After the pause operation was completed and the tail end 10B of the preceding metal block moved downstream from the lifting table zone (in FIG. 8, the position of the lifting table on the most downstream side adjacent to the stroke end position for the traveling joining unit is the downstream end of the lifting table zone), the table pressing guides 45A and 45B were raised, and the clamps 44A and 44B and the inductor 43 were raised (opened), as shown in FIG. 13. In this case, since the relative relationship between the travel stop position of the joining unit 40 and the position of the lifting table must be appropriate, as shown in FIG. 13, the joining unit 40 was stopped so that the positional relationship be appropriate. More specifically, according to the procedure shown in FIG. 24, the joining unit 40 moved and stopped at the position 6.15 m, called a maintenance position so that the relative relationship between the travel stop position of the joining unit 40 and the position of the lifting table be appropriate (Step 250), and the table pressing guides 45A and 45B were raised (Step 300), whereby the preparation for feeding the succeeding metal block 12 was completed. In this embodiment, since the leading end 12A of the succeeding metal block was stopped at the 1.5 m position after the joining operation was aborted (Step 240), the joining unit was stopped at the maintenance position 6.15 m (Step 250), whereas the control logic is designed so that the joining unit 40 move to the intermediate position 13.50 m (Step 270) when the leading end 12A stops at the position within a range of 6.5 m to 13.50 m (Step 260), and so that the joining unit 40 move to the stroke end position 20.00 m (Step 290) when the leading end 12A stops at the position within a range of 13.50 m to 20.00 m (Step 280). Theoretically, a joining unit stop position such that an appropriate relative relationship is formed between the stop position of the joining unit 40 and the position of the lifting table lies at every pitch of the lifting table rollers. In this embodiment the control logic is simplified by shifting the joining unit 40, after the joining operation is aborted, to one of the three positions, the maintenance position, the intermediate position, and the stroke end position, which is downstream from and closest to the stop position of the succeeding metal block leading end 12A.

Figure 25:
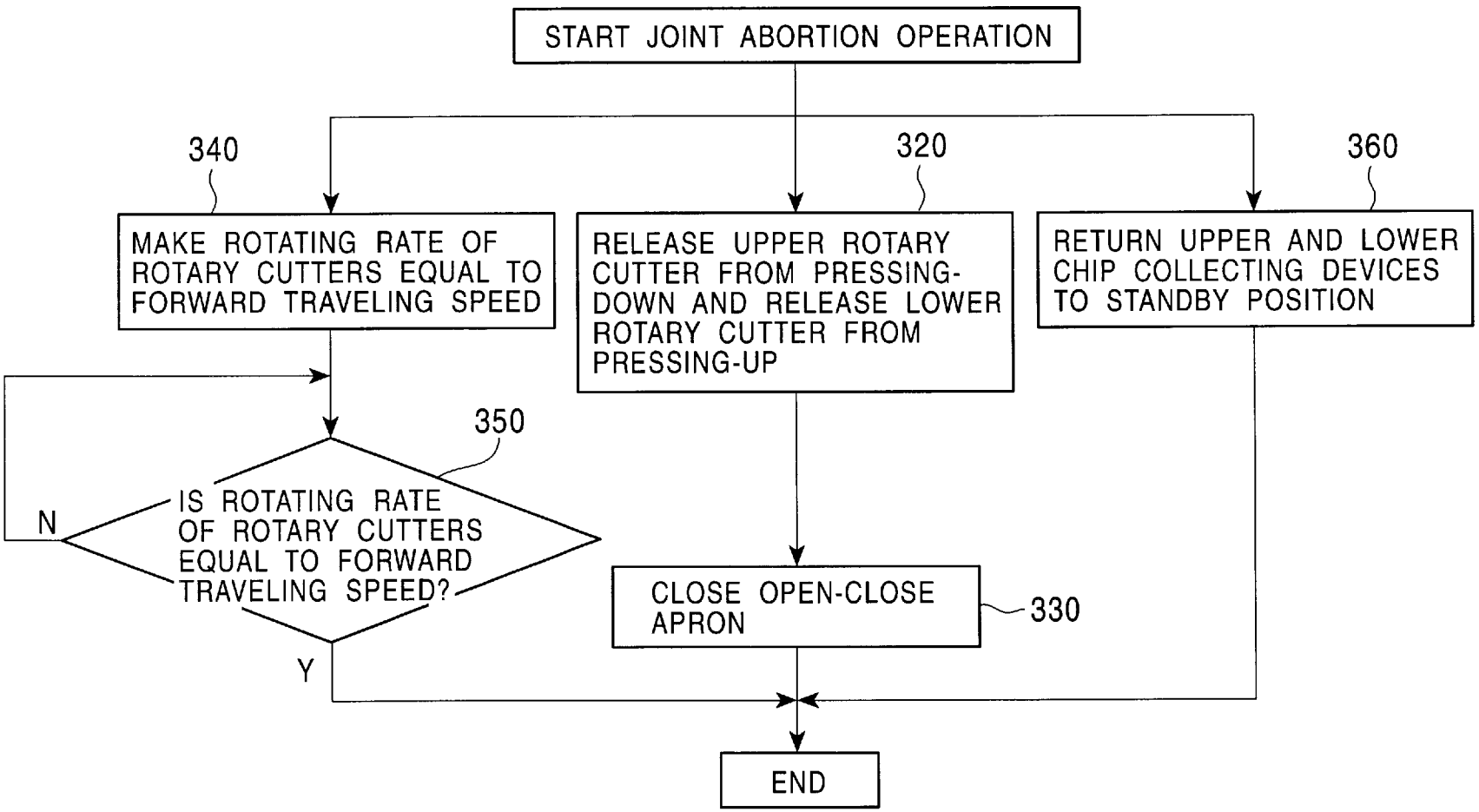
FIG. 25 is a flowchart showing the operation procedure of the treatment unit when joining is aborted.

During this, in the treatment unit 50, the pressing-down device 51 and the pressing-up device 53 are released (Step 320), the openable and closeable apron 55 is closed (Step 330), and the rotary cutters 52 and 54 are rotated forward at 180 mpm that is substantially equal to the material feeding speed (in a case in which the rotary cutter diameter is 950 mm, and the rotation speed is 60 rpm) (Step 340, Step 350), as shown in FIG. 16, according to the procedure shown in FIG. 25. The upper and lower chip collecting devices 56 and 57 are returned to the standby positions (Step 360). The succeeding metal block feeding speed is set at 150 mpm from when the feeding of the succeeding metal block is restarted, after the joining operation is aborted, until when the succeeding metal block is bitten by the finish-rolling unit.

For a while, the completion of the preparation for threading the succeeding metal block and the completion of finish-rolling of the preceding metal block 10 are awaited by the joining unit 40 and the treatment unit 50.

Figure 26:
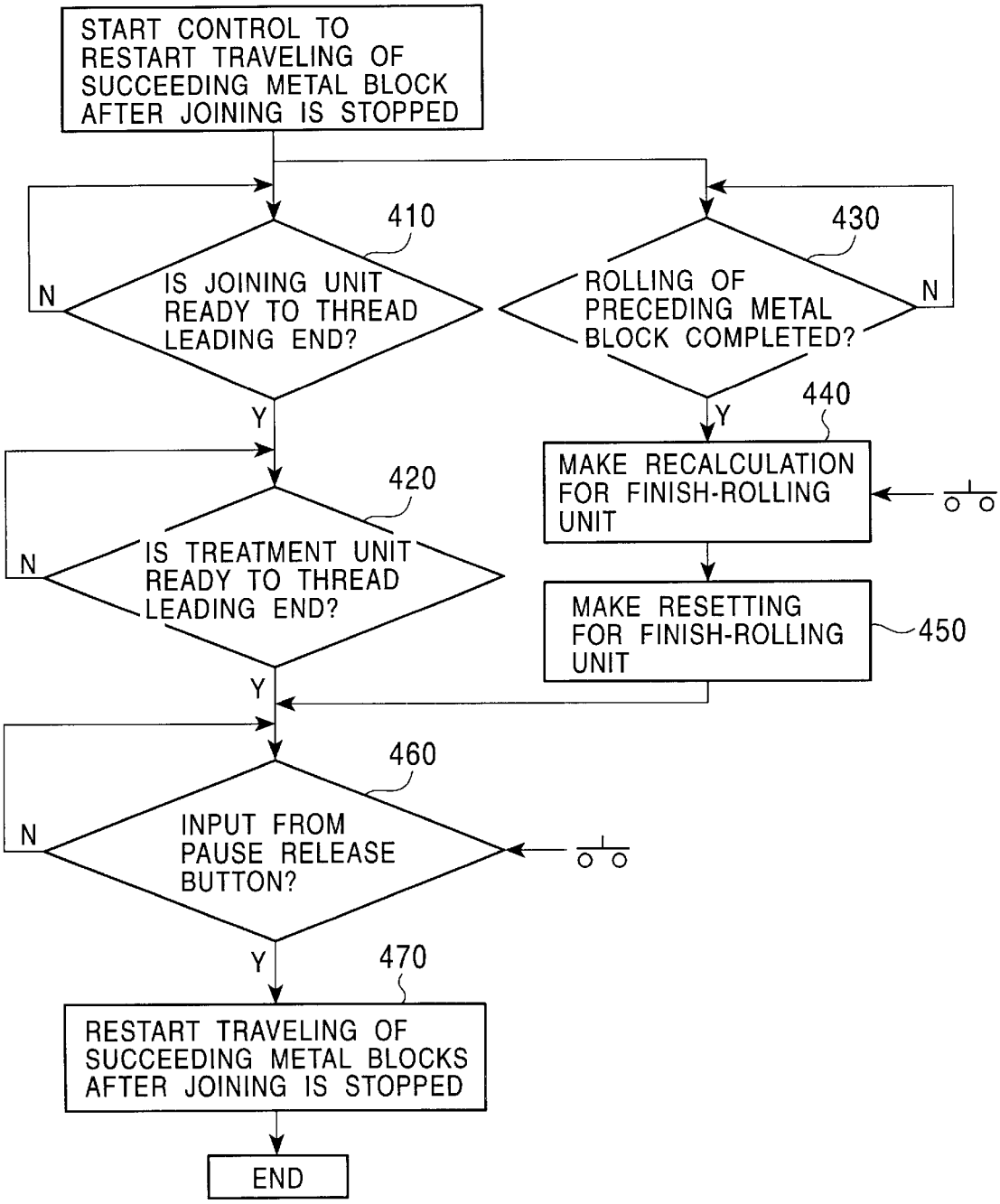
FIG. 26 is a flowchart showing the procedures for recalculation and resetting for the succeeding metal block in the finish-rolling unit when joining is aborted.

After finish-rolling of the preceding metal block 10 is completed, recalculation (Step 440) and resetting (Step 450) for finish-rolling of the succeeding metal block by the finish-rolling unit are carried out by pushing the button at the discretion of the operator, according to the procedure shown in FIG. 26.

As the present applicant discloses in Japanese Unexamined Patent Application No. 11-169926, when setting and calculation are performed beforehand for both endless rolling and batch rolling, the recalculation in Step 440 is unnecessary.

In this example, the third metal block, serving as a succeeding metal block after the joining operation is aborted, is rolled to 2.6 mm instead of the target thickness 1.0 mm, thereby preventing the leading end of the metal block from sticking in the side guide. FIG. 27 shows examples of rolling schedules for the third metal block before and after the joining operation is aborted. FIG. 28 shows target thicknesses of the materials to be subjected to hot rolling. As shown in FIG. 28, the fourth metal block, which is to be the last block to be subjected to endless rolling, is batch-rolled to 1.2 mm because the traveling thickness change from the thickness of 2.6 mm of the third metal strip to 1.2 mm is impossible.

By pressing the pause release button at the discretion of the operator (Step 460), the feeding of the succeeding metal block and subsequent metal blocks is restarted (Step 470).

While the present invention is applied to hot rolling for metal strips in the above description, it is obvious that the present invention is not applicable only to this, but is similarly applicable to hot rolling for metal materials in general.

EXAMPLE 2

It is assumed that an operation of joining the tail end of the first metal block and the leading end of the second metal block of four blocks to be joined was stopped during endless rolling (the first to fourth are low-carbon steel blocks of 4.0×1000 mm).

When the joining operation is aborted, the travel of the joining unit 40 and the feeding of a succeeding metal block 12 are temporarily stopped in synchronized velocity. When the joining operation is aborted, the leading end 12A of the succeeding metal block (second) stopped at a position 8.0 m shifted from the starting position (reference position) in the travel zone of the joining unit 40, as shown in FIG. 8. Subsequently, in a manner similar to that in Example 1, the joining unit 40 moved and stopped at the position 13.50 m, called an intermediate position, so that the relative relationship between the travel stop position of the joining unit 40 and the position of the lifting table be appropriate (Step 270), and the table pressing guides 45A and 45B were raised (Step 300), whereby the preparation for feeding the succeeding metal block 12 was completed. The treatment unit 50 was also subjected to an operation similar to that in Example 1. FIG. 29 shows examples of rolling schedules for the second metal block before and after the joining operation is aborted. FIG. 30 shows target thicknesses of the materials to be subjected to hot rolling. In Example 2, the second metal block, which serves as a succeeding metal block after the joining operation was aborted, was finish-rolled to the initially set thickness of 4.0 mm, and the third and fourth metal blocks were then joined and subjected to continuous rolling.

EXAMPLE 3

It is assumed that the tail end of the second metal block and the leading end of the third metal block of four blocks to be joined were incompletely joined during continuous hot rolling (the first is a low-carbon steel block of 1.2×1000 mm, the second is a low-carbon steel block of 1.0×1000 mm, the third is a low-carbon steel block of 1.0×1000 mm, and the fourth is a low-carbon steel block of 1.2×1000 mm).

When joining is incomplete, the joining unit 40 travels to the most downstream end of the travel zone in synchronization with the feeding speed of a preceding metal block 10 and a succeeding metal block 12, and stops there. Furthermore, a command to stop removing defective joint portions (burrs) is issued from the control unit 88 to the treatment unit 50. In response to this command, the treatment unit 50 remains in a cutting standby state (a state shown in FIG. 22), and does not perform a cutting operation. Subsequently, the preceding metal block 10 is automatically cut once at a target position 500 mm offset from a joint 11 toward the finish-rolling unit (on the side of the preceding metal block) by the crop shear 24 on the side of the finish-rolling unit. After cutting, the feeding of the succeeding metal block 12 is temporarily stopped. At this time, the operator 86 visually confirms, based on the image on the monitor 82, how many meters back from the first cutting end the joint 11 lies. If it is assumed that it is confirmed, as a result, that the joint 11 lies 600 mm back from the first cutting end, the operator determines that cutting should be performed twice more by the crop shear 24.

This is because a series of operations, when the pushbutton 84 is pushed once, the advance by 500 mm and stop of the succeeding metal block 12, and one cut by the crop shear 24, are continuously and automatically performed in sequence, and the cutting position shifts back by 500 mm in every cutting operation, as shown in FIG. 9.

Therefore, the incomplete joint 11 can be surely removed by cutting and removing a portion of 500 mm twice more, that is, 1000 mm in total, by the crop shear 24. Incidentally, the two cutting operations after one automatic cutting operation were performed by two pushes of the pushbutton 84 by the operator 86.

In contrast to the target cutting position in the first cutting operation set 500 mm offset from the joint 11 toward the finish-rolling unit, the actual cutting position was placed 600 mm offset from the joint 11 toward the finish-rolling unit due to a tracking error of the joint 11. In this case, a tracking error of 100 mm was made with respect to the joint position on the opposite side from the finish-rolling unit 26.

While the first cutting operation was performed automatically and the two subsequent cutting operations were carried out at the discretion of the operator 86 in this example, the discretion and operation of the operator can be eliminated by estimating the maximum amount of the tracking error of the joint 11, and automatically cutting a portion by a certain length, which is longer than the length when the maximum tracking error is made, in any case. For example, if it is known from the result of historical statistics that the detected joint position deviates by 400 mm at the maximum, the actual cutting position may vary between a position 400 mm shifted from the joint toward the finish-rolling unit and a position 400 mm toward the opposite side due to tracking errors in contrast to the target position in the first cutting operation which is 500 mm shifted from the joint toward the finish-rolling unit. Therefore, in any of the cases, it is necessary to automatically perform cutting twice more, that is, to cut by a length of 1000 mm in total in order to surely remove the joint 11.

Figure 31:
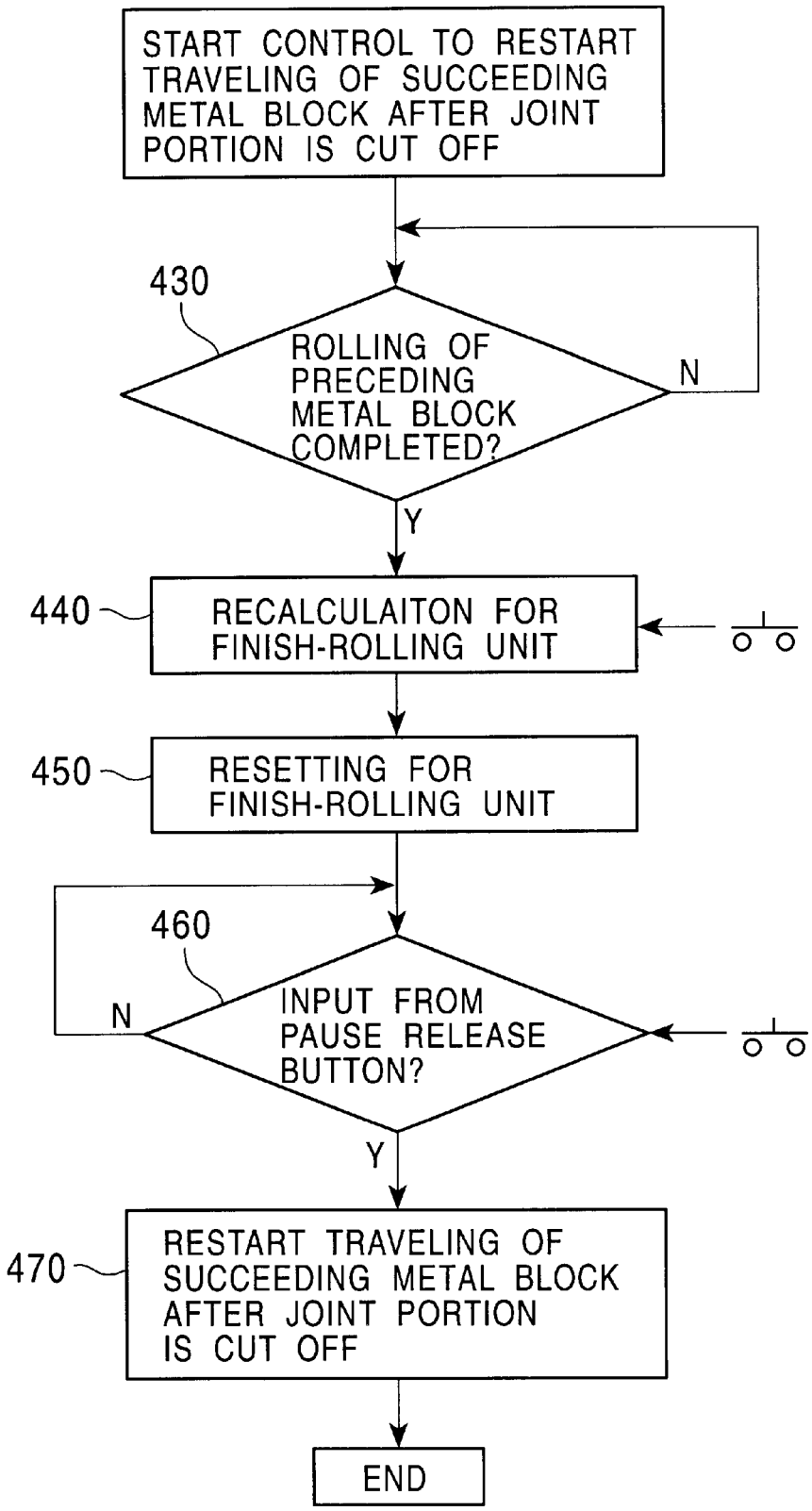
FIG. 31 is a flowchart showing the procedures for recalculation and resetting for the succeeding metal block in the finish-rolling unit after the joint is cut.

After finish-rolling of the preceding metal block 10 is completed, recalculation (Step 440) and resetting (Step 450) for rolling the succeeding metal block by the finish-rolling unit are carried out by pushing the button at the discretion of the operator, according to the procedure shown in FIG. 31.

As described above, and as the present applicant proposes in Japanese Unexamined Patent Application No. 11-169926, when setting and calculation were performed beforehand for both endless rolling and batch rolling, the recalculation in Step 440 is unnecessary.

When it was determined that the joint 11 between the preceding metal block 10 and the succeeding metal block 12 joined incompletely moved downstream from the travel zone of the joining unit 40, the joining unit 40 moved to the maintenance position shown in FIG. 8, and was brought into a state in which the table pressing guides 45A and 45B were raised and the clamps 44A and 44B and the inductor 43 were raised (opened), as shown in FIG. 13. The relative relationship between the travel stop position of the joining unit 40 and the position of the lifting table rollers 66 is designed to be appropriate in this state, as shown in FIG. 13. In this state, the preparation for feeding the leading end of a metal block subsequent to the succeeding metal block is completed.

Figure 32:
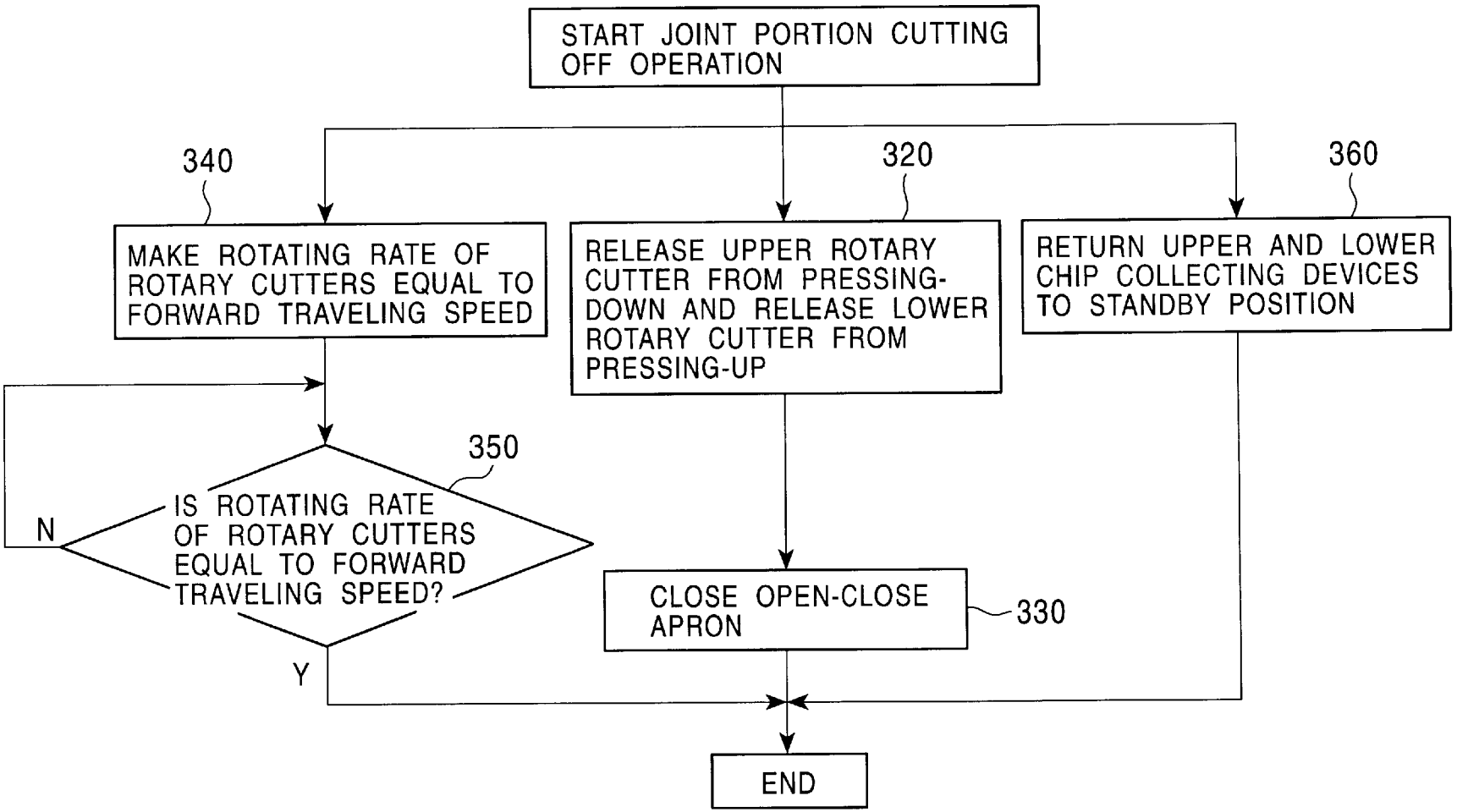
FIG. 32 is a flowchart showing the operation procedure of the treatment unit when it is determined that joining is incomplete.

In the treatment unit 50, after the joint 11 has passed therethrough, as shown in FIG. 16, the upper and lower rotary cutters 52 and 54 are released by the pressing-down device 51 and the pressing-up device 53 (Step 320), the openable and closeable apron 55 is closed (Step 330), and the rotary cutters 52 and 54 are rotated in the forward direction the same as the material feeding direction at 180 mpm that is substantially equal to the material feeding speed (in a case in which the rotary cutter diameter is 950 mm, and the rotation speed is 60 rpm) (Step 340, Step 350), according to the procedure shown in FIG. 32. Incidentally, the feeding speed for the succeeding metal block 12 is set at 150 mpm from when the feeding is restarted after the joint is cut until when the succeeding metal block 12 is bitten by the finish-rolling unit. In this state, the preparation for feeding the leading end of the subsequent metal block is also completed in the treatment unit 50.

In this example, the third metal block, serving as a succeeding metal block after the joint is cut, is rolled to 2.6 mm instead of the target thickness 1.0 mm, thereby preventing the leading end of the metal sheet from sticking in the side guide. FIG. 33 shows a rolling schedule for the third metal block before the joint is cut, and a rolling schedule after the joint is cut.

Furthermore, FIG. 34 comparatively shows the target finishing thicknesses of the first to fourth metal blocks, and the finishing thicknesses (results) of the first to fourth metal strips after the joint between the second metal block and the third metal block is cut.

As is evident from FIG. 34, the fourth metal block, which is the last block to be subjected to continuous hot rolling, is batch-rolled to 1.2 mm.

In addition, the pause release button is pressed at the discretion of the operator (Step 460 in FIG. 31), and the feeding of the succeeding metal block and subsequent metal blocks is thereby restarted (Step 470).

EXAMPLE 4

It is assumed that the tail end of the first metal block and the leading end of the second metal block of four blocks to be joined be joined incompletely during endless rolling (the first to fourth are low-carbon steel blocks of 4.0×1000 mm).

Subsequent operations of the joining unit, the treatment unit, and the crop shear are the same as those in Example 3. FIG. 35 shows examples of rolling schedules for the second metal block before and after the joint is cut. FIG. 36 shows target thicknesses of the hot-rolled products.

In Example 4, the second metal block, which serves as a succeeding metal block after the joining trouble arises, was finish-rolled to the initially set thickness of 4.0 mm, and the third and fourth metal blocks were then joined and subjected to continuous rolling.

While the present invention is applied to hot rolling for metal blocks in the above description, it is obvious that the present invention is not applicable only to this, but is similarly applicable to cold rolling for metal blocks in general.

INDUSTRIAL APPLICABILITY

According to the present invention, when any trouble arises before joining in hot continuous rolling, joining is aborted. When any trouble arises after joining, the joint is cut, subsequent devices concerned with joining are operated into a state that does not hinder the threading and feeding of metal blocks, and a succeeding metal block, after joining is aborted or after the joint is cut, is intermittently but smoothly supplied to the finish-rolling unit to be finish-rolled. Therefore, even when trouble arises before, during, or after joining, it is unnecessary to stop the operation of the line.

What is claimed is:

1. A hot rolling method for metal blocks using a hot rolling system for joining the leading end of a succeeding metal block to the tail end of a preceding metal block on the inlet side of a finish-rolling mill and for finish-rolling the succeeding metal block and the preceding metal block in succession, wherein it is determined before, during, and after the joining operation whether or not the succeeding metal block can be finish-rolled in succession to the preceding metal block, wherein, when it is determined that the succeeding metal block cannot be finish-rolled in succession to the preceding metal block, the joining operation is aborted or a joint is cut, and rolling operations are performed in downstream devices including a joining unit under the conditions set for batch rolling.

2. A hot rolling method for metal blocks according to claim 1, wherein, when it is determined that the succeeding metal block cannot be finish-rolled in succession to the preceding metal block, an operation of joining the leading end of the succeeding metal block and the tail end of the preceding metal block is aborted when the metal blocks are separate, and a region including the joint therebetween is cut between said joining unit and a finish-rolling mill when the metal blocks are joined incompletely, wherein said downstream joining devices including said joining unit are brought into a state that allows the leading end of the succeeding metal block to be threaded therethrough, and wherein at least the leading end of the succeeding metal block is bitten by said finish-rolling mill set for batch rolling.

3. A hot rolling method for metal blocks according to claim 1, wherein, when it is determined, before joining, that the succeeding metal block cannot be finish-rolled in succession to the preceding metal block, said joining devices are brought into a state that allows the leading end of the succeeding metal block to be threaded therethrough, wherein a setting of said finish-rolling mill is made for batch rolling so that the leading end of the succeeding metal block be bitten by said finish-rolling mill, after the tail end of the preceding metal block moves out of said finish-rolling mill, and wherein the leading end of the succeeding metal block is threaded through said joining devices and is bitten by said finish-rolling mill.

4. A hot rolling method for metal blocks according to claim 1, wherein it is determined, after joining, whether or not the succeeding metal block and the preceding metal block can be finish-rolled in succession, according to whether or not the joining operation was performed successfully, wherein, when it is determined that the joining operation was not performed successfully, a region including the joint therebetween is cut between said joining unit and a finish-rolling mill, and wherein at least the leading end of the succeeding metal block is bitten by said finish-rolling mill set for batch rolling.

5. A hot rolling method for metal blocks according to claim 4, wherein the joint between the preceding metal block and the succeeding metal block incompletely joined is fed in synchronized velocity with the travel of said joining unit before the region including the joint is cut, and wherein said joining unit travels and stops at the most downstream end of the travel zone, and the succeeding metal block is continuously fed at the finish-rolling speed of the preceding metal block.

6. A hot rolling method for metal blocks according to claim 1, wherein a finishing thickness range that allows batch rolling is preset, and wherein the succeeding metal block is finish-rolled with the finishing thickness of at least the leading end thereof changed to be within the thickness range when the target finishing thickness of the succeeding metal strip for continuous rolling is out of the thickness range.

7. A hot rolling method for metal blocks according to claim 1, wherein, when said joining unit is mounted on a truck and moves while sequentially depressing lifting table rollers with the movement of said truck with table pressing guides on the inlet side and the outlet side of the joining device placed in the down position, and sequentially returning said lifting table rollers back to the unpressed initial height state after said truck passes, said truck is stopped, after the joining operation is aborted or is finished incompletely, at a position such that the distance Q between said table rollers and the outermost one of feeding rolls provided with said truck prevents the succeeding metal blocks from entering between said rolls due to downward bending while said table pressing guide on the outlet side is in the upper limit position, and wherein said outlet-side table pressing guide is raised to the upper limit position, and the succeeding metal block or the joint is fed downstream from said joining unit.

8. A hot rolling method for metal blocks according to claims 1, wherein, when said joining unit clamps the succeeding metal block and the preceding metal block with a predetermined space formed between the leading end of the succeeding metal block and the tail end of the preceding metal block, heats the leading and the tail end in this state, and joins the leading end and the tail end by pressing, it is determined, based on the amount of displacement by pressing, whether or not joining has been successfully performed.

9. A hot rolling method for metal blocks according to any one of claim 1, wherein a treatment unit disposed between said joining unit and a finish-rolling mill so as to treat the joint is brought into a state in which the joint is not treated, and the leading end of the succeeding metal block or the joint is threaded therethrough.

10. A hot rolling method for metal blocks according to claim 9, wherein said treatment unit includes a deburring device placed on the outlet side of said joining unit so as to deburr the joint by rotary cutters, disposed above and below the pass line to be rotated in the opposite direction from the feeding direction of the succeeding metal block, and to remove a bur produced at the joint, and deburring by said deburring device is aborted when it is determined that the joining operation was not performed successfully.

11. A hot rolling method for metal blocks according to claim 1, wherein said hot rolling system allows the traveling sheet thickness change for changing the finishing thickness during finish rolling, and a changeable thickness range in accordance with the traveling thickness change is preset, wherein, when s subsequent metal block subsequent to the succeeding metal block and the succeeding metal block finish-rolled to a different thickness from the target thickness for continuous rolling are finished-rolled in succession, it is determined whether or not the amount of change in thickness from the finishing thickness of the succeeding metal strip to the target finishing thickness of the subsequent metal strip is within the changeable thickness range, and wherein, when the change amount is out of the changeable thickness range, the finishing thickness of the subsequent metal strip is changed so that the amount of change in thickness be within the changeable thickness range, and the subsequent metal block and the succeeding metal block are joined and are subjected to continuous finish rolling.

12. A hot rolling method for metal blocks according to claim 11, wherein, when the amount of change in thickness from the finishing thickness of the succeeding metal strip to the target finishing thickness of the subsequent metal strip is out of the changeable thickness range, the succeeding metal block and the subsequent metal block are not joined, and rolling operations are performed in said downstream devices including said joining unit under the conditions set for batch rolling.

* * * * *